US010020581B2

(12) United States Patent
Diaz et al.

(10) Patent No.: US 10,020,581 B2
(45) Date of Patent: Jul. 10, 2018

(54) PARALLEL SOLENOID FEEDS FOR MAGNETIC ANTENNAS

(71) Applicants: Rodolfo Diaz, Phoenix, AZ (US); Tara Yousefi, Tempe, AZ (US); Tom Sebastian, Tempe, AZ (US); Sergio Clavijo, Phoenix, AZ (US)

(72) Inventors: Rodolfo Diaz, Phoenix, AZ (US); Tara Yousefi, Tempe, AZ (US); Tom Sebastian, Tempe, AZ (US); Sergio Clavijo, Phoenix, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 212 days.

(21) Appl. No.: 15/180,822

(22) Filed: Jun. 13, 2016

(65) Prior Publication Data

US 2016/0365642 A1 Dec. 15, 2016

Related U.S. Application Data

(60) Provisional application No. 62/174,244, filed on Jun. 11, 2015.

(51) Int. Cl.
*H01Q 7/06* (2006.01)

(52) U.S. Cl.
CPC ..... *H01Q 7/06* (2013.01)

(58) Field of Classification Search
CPC ..... H01Q 7/00; H01Q 7/06; H01Q 7/08
See application file for complete search history.

(56) References Cited

PUBLICATIONS

D. Auckland et al., "A New Type of Conformal Antenna Using Magnetic Flux Channels", 2014 IEEE Military Communications Conference (MILCOM), Oct. 6-8 (2014).

T. Sebastian et al., "A new realization of an efficient broadband conformal magnetic current dipole antenna", 2013 IEEE Antennas and Propagation Society International Symposium (APSURSI), Jul. 7-13, 2013.

T. Sebastian, "Magneto-Dielectric Wire Antennas Theory and Design", PhD Thesis, Arizona State University, 2013.

*Primary Examiner* — Robert Karacsony
(74) *Attorney, Agent, or Firm* — Quarles & Brady LLP

(57) ABSTRACT

The present disclosure provides systems and methods for enhancing the performance of permeable antennas. Further, the parallel solenoid feed system disclosed herein may be used to reduce or eliminate significant phase delays in antennas, which may lead to destructive interference. Moreover, use of the parallel solenoid feed in an antenna eliminates the need for multiple feeds, complicated feed networks, and elaborate matching circuits. Using the parallel solenoid feed in circular magnetic antennas may enhance the performance of the antenna through maintaining the flux. Finally, many adjustable parameters for further tuning and/or optimizing the performance of particular antenna design have been identified herein, which may allow those skilled in the art to utilize known systems, such as full wave simulation software, to determine the desired final design for an antenna utilizing a parallel solenoid feed.

21 Claims, 49 Drawing Sheets

| line | Distance from feed(mm) |
|---|---|
| 1 | 25.8 |
| 2 | 50.8 |
| 3 | 154.4 |
| 5 | 244.4 |
| 6 | 355.6 |
| 10 | 555.6 |
| 13 | 771.6 |
| 14 | 841.6 |
| 19 | 1191.6 |
| 20 | 1261.6 |
| 23 | 1546.4 |
| 26 | 1801.4 |

| line | Distance from feed(mm) |
|---|---|
| 1 | 25.8 |
| 2 | 50.8 |
| 3 | 154.4 |
| 5 | 244.4 |
| 6 | 355.6 |
| 10 | 555.6 |
| 13 | 771.6 |
| 14 | 841.6 |
| 19 | 1191.6 |
| 20 | 1261.6 |
| 23 | 1546.4 |
| 26 | 1801.4 |

PARALLEL SOLENOID FEEDS FOR MAGNETIC ANTENNAS

CROSS REFERENCES TO RELATED APPLICATIONS

This application claims priority to U.S. Provisional Application No. 62/174,244 filed on Jun. 11, 2015, the disclosure of which is hereby incorporated by reference in its entirety.

STATEMENT REGARDING FEDERALLY SPONSORED RESEARCH

This invention was made with government support under Contract No. N68335-12-C-0063 awarded by the U.S. Naval Air Systems Command. The government has certain rights in the invention.

BACKGROUND OF INVENTION

In the technical field of antennas, there is an ever growing need for broadband conformal antennas to not only reduce the number of antennas utilized to cover a broad range of frequencies (VHF and UHF), but also to reduce the visual and RF signatures associated with communication and radar systems. Prior art conformal metallic antennas have narrow bandwidth and low efficiency.

A magnetic current, instead of an electric current, may be used as the primary source of radiation in antennas, such as in antennas with very high permeabilities. Such antennas with a magnetic current as the primary source of radiation will be referred to as "true magnetic" antennas with a relative permeability $\mu_r >> 1$ and dielectric constant $\epsilon_r > 1$. Advantageously, when mounting true magnetic antennas on a conducting ground plane, there is no loss of gain or efficiency. The radiating magnetic current is aided by the image current produced by the metallic ground plane.

True magnetic antennas use permeable materials as their radiating elements and are ideal for electrically small conformal antenna applications. True magnetic antennas have many applications that cannot be obtained by prior art antennas, therefore the optimum feeding of these antennas is of great interest.

Magnetic antennas may use solenoid feeds to enhance antenna performance. However, previous solenoid feeds have significant phase delays, which lead to destructive interference. In order to reduce this phase shift interference, previous solenoid feed systems require complicated feed networks and/or elaborate matching circuits.

Therefore, systems and methods for enhancing antenna performance, such as peak gain and current distribution, and eliminating phase delays and other issues, are highly desirable.

SUMMARY OF THE INVENTION

The present disclosure provides a new kind of electric feed configuration for use in permeable magnetic antennas, which overcomes the problems of conventional solenoid feeds and the slightly better performing multiple parallel loop feed systems.

Previously used conformal metallic antennas have narrow bandwidth and low efficiency because they use an electric current as their radiation source. Since these antennas are mounted on a conducting ground plane, the electric current fights the opposing image current caused by the ground plane.

The present disclosure provides designs for a feed structure that optimizes the magnetic current distribution and the input impedance of true magnetic antennas. Specifically, the disclosed feed structure configurations may be used to improve the broadband matching of broadband antennas or as specific tuning aids for narrower band applications.

In one aspect, the invention provides a feed for a magnetic antenna with a ground plane. The magnetic antenna has a width, a height perpendicular to the ground plane, and a length longer than the width and the height. The feed comprises: a first conductor and a second conductor bisecting the width of the magnetic antenna; a first set of shorting pins electrically connecting the first conductor and the ground plane at generally regular intervals along the length of the antenna; and a second set of shorting pins electrically connecting the second conductor and the ground plane at generally regular intervals along the length of the antenna.

The first set of shorting pins and the second set of conductor pins can be substantially parallel to the width of the magnetic antenna. The first conductor can be electrically connected to an inner conductor of a coaxial feed and the second conductor can be electrically connected to an outer conductor of the coaxial feed. The first and second conductors can be substantially parallel to the length of the magnetic antenna; and the magnetic antenna can be a dipole antenna and is excited by a substantially in-phase magnetic current induced by the first and second conductors. A distance between the first and second sets of shorting pins can be equal to:

$$2\sqrt{\frac{2hw}{\pi}} \pm 50\%$$

wherein h and w are the height and width of the magnetic antenna, respectively.

The magnetic antenna can be a circular magnetic antenna The feed can comprise a set of feed loops. The first conductor can comprise a set of first conductors, wherein each conductor in the set of first conductors is electrically connected to a feed loop in the set of feed loops; and the second conductor can comprise a set of second conductors, wherein each conductor in the set of second conductors is electrically connected to a feed loop in the set of feed loops. The first and second sets of shorting pins can be substantially parallel to the width of the magnetic antenna. The set of feed loops can be substantially parallel to the width of the magnetic antenna at substantially regular intervals along the length of the magnetic antenna. Each feed loop in the set of feed loops can be electrically connected to a coaxial feed loop, wherein the coaxial feed loop had an inner conductor electrically connected to a conductor in the set of first conductors and an outer conductor electrically connected to a conductor in the set of second conductors. The first and second sets of shorting pins can be arranged in groups of shorting pins, wherein each group of shorting pins corresponds to a feed loop in the set of feed loops, and within each group of shorting pins, the first and second sets of shorting pins and the corresponding feed loops can be arranged at substantially regular intervals along the length of the magnetic antenna. Within each group of shorting pins, a distance between the first and second sets of shorting pins can be equal to:

$$2\sqrt{\frac{2hw}{\pi}} \pm 50\%$$

wherein h and w are the height and width of the magnetic antenna, respectively.

The first conductor can be separated from the magnetic antenna by a distance substantially equal to a largest cross section of the first conductor. The second conductor can be separated from the magnetic antenna by a distance substantially equal to a largest cross section of the second conductor.

The first set of shorting pins can be separated from the magnetic antenna by a distance substantially equal to a largest cross section of the first set of shorting pins. The second set of shorting pins can be separated from the magnetic antenna by a distance substantially equal to a largest cross section of the second set of shorting pins.

The first set of shorting pins can include a circuit element between the first conductor and the ground plane. The circuit element can be a resistor, an inductor, or a capacitor. The second set of shorting pins can include a circuit element between the second conductor and the ground plane. The circuit element can be a resistor, an inductor, or a capacitor.

The magnetic antenna can comprise a magnetic material with a permeability and a permittivity, wherein the permeability is at least three times greater than the permittivity in magnitude.

The foregoing and other objects and advantages of the invention will appear from the following detailed description. In the description, reference is made to the accompanying drawings which illustrate an embodiment of the invention.

DETAILED DESCRIPTION OF THE INVENTION

The present disclosure provides systems and methods for enhancing the performance of magnetic antennas. The disclosed systems and methods for using a parallel solenoid feed in permeable antennas enhance the performance of the antennas through reducing the significant phase delays that cause destructive interference. Additionally, in antennas such as magnetic linear dipoles, the parallel solenoid feed design eliminates the need for multiple feeds, thereby eliminating the need for complicated feed networks and elaborate matching circuits.

A permeable dipole antenna is the electromagnetic dual of a dielectric dipole. The duality between the electric and magnetic dipole is summarized in Table 1 below.

TABLE 1

Comparing an Electric and Magnetic Dipole

| Electric Dipole | Magnetic Dipole |
|---|---|
| Electric Voltage Feed | Magnetic Voltage Feed |
| Carrying Electric Current ($I_e$) | Carrying Magnetic Current ($I_m$) |
| Perfect Electric Conductor Feed Line | Perfect Magnetic Conductor Feed Line |
| Electric Input Impedance (ohms) | Magnetic Input Impedance (siemens) = (Electric Input Impedance (ohms) ÷ $\eta_0^2$) |

Figure 1:
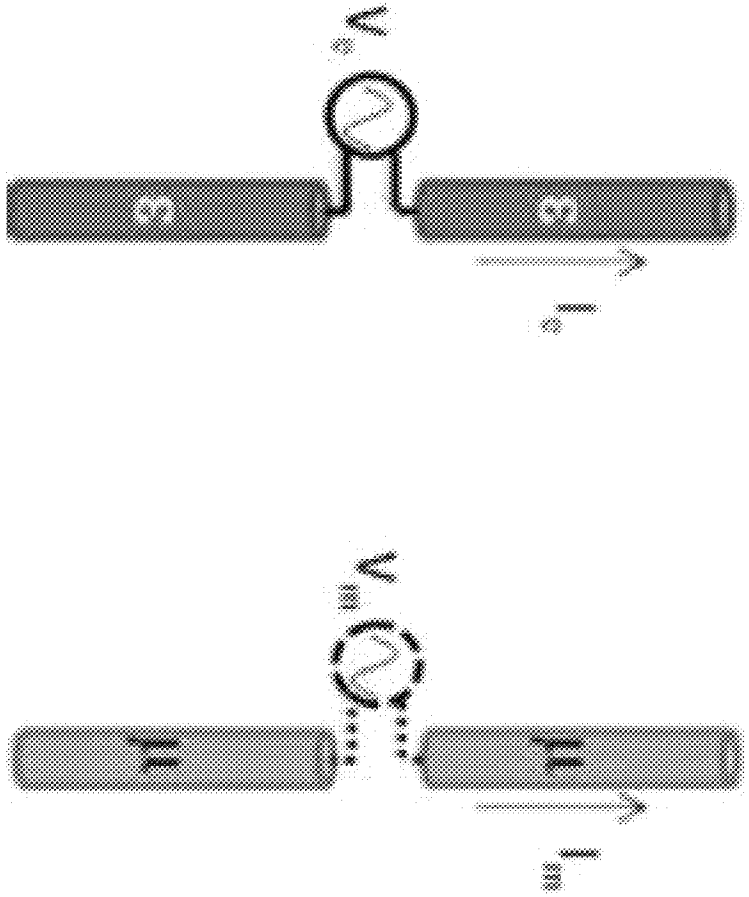
FIG. 1 is a schematic of an electric and magnetic dipole.
Figure 2:
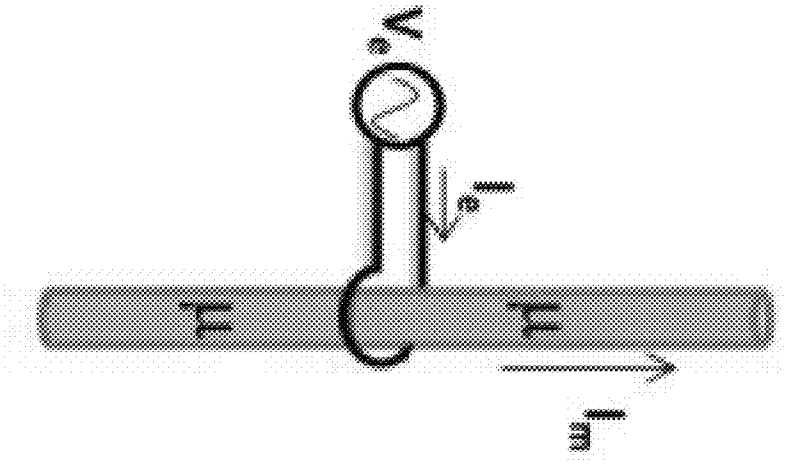
FIG. 2 is a schematic of a magnetic dipole with a feed loop.

FIG. 1 shows an electric and magnetic dipole having a As shown in FIG. 1, in comparing an electric dipole with a magnetic dipole, it can be seen that where an electric dipole has perfect electric conductor (PEC) feed lines and an electric voltage source ($V_e$), a magnetic dipole should have perfect magnetic conductor (PMC) feed lines and a magnetic voltage source ($V_m$). However, in place of PMC feed lines and a magnetic voltage source, a PEC feed loop, as seen in FIG. 2, may be used to feed the magnetic dipole.

The fundamental magnetic conductor dipole may be fed by an electrically small current loop or many loops forming a solenoid.

Conventional solenoid feeds create significant phase delay when moving away from the feed center, which can cause destructive interference. A multi-loop parallel feed involves a complicated feed network and usually requires an elaborate matching circuit.

The feed of the present disclosure, referred to as a "parallel solenoid feed", utilizes just a single feed loop for a rectangular magnetic current dipole antenna. The parallel solenoid eliminates the need for complicated matching circuits for a rectangular dipole. Further, even though multiple loops are used for a circular magnetic dipole, a multiple feed with a proper solenoid has superior performance over a multiple feed without a solenoid.

Figure 11:
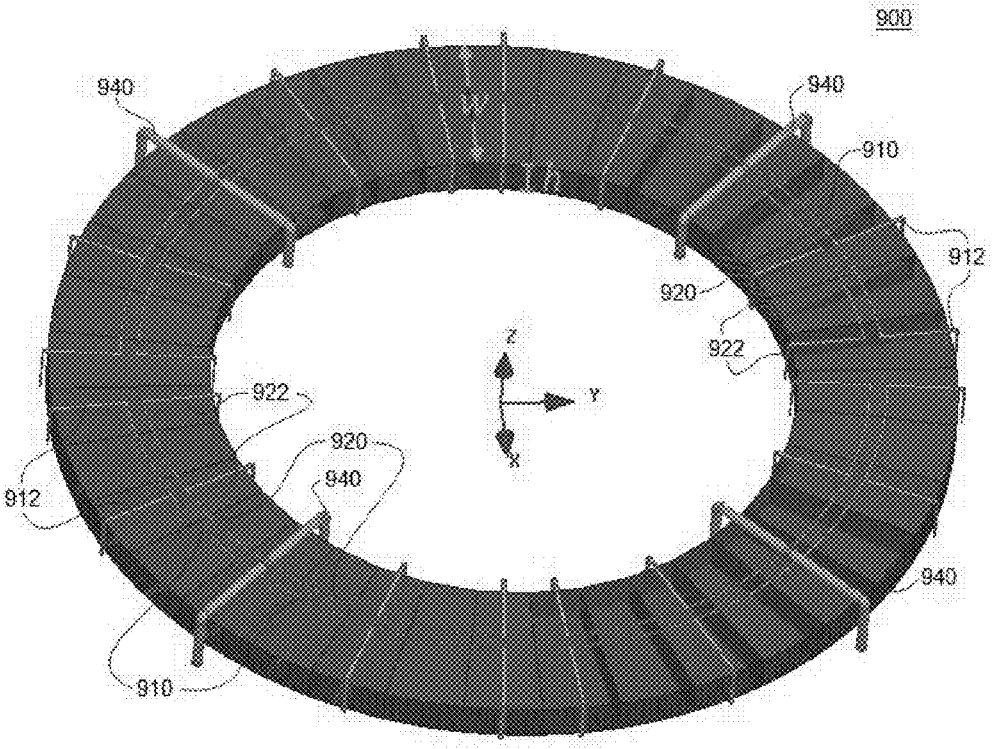
FIG. 11 is a schematic of a monopole mode of a magnetic current loop with four feed loops and a parallel solenoid cage with 16 solenoid bars, in accordance with the present disclosure.

Parallel solenoid feeds, such as those indicated by reference 200 in FIG. 4 and by reference 900 in FIG. 11, for example, may be used in magnetic antennas to enhance antenna performance.

Figure 3:
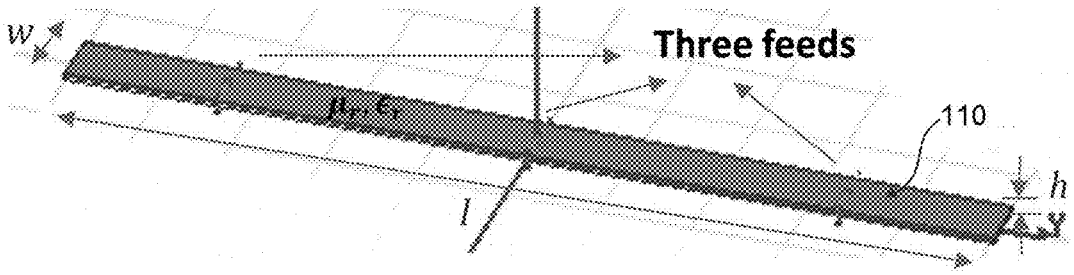
FIG. 3 is a schematic of a magnetic dipole antenna with multiple electric loop feeds.

In one non-limiting example, a magnetic dipole antenna 110 having length l, width w, and height h, as shown in FIG. 3, may be radiated by a single magnetic current from a single feed, such as a parallel solenoid feed 200, as shown in FIG. 4. The feed 200 includes a first conductor 210 and a second conductor 220 bisecting the width w along the length l of the magnetic dipole antenna 110. The feed 200 further includes a first set of shorting pins 212 that connect the first conductor 210 to a ground plane and a second set of shorting pins 222 that connect the second conductor 220 to the ground plane. The first and second sets of shorting pins 212, 222 may connect the first and second conductors 210, 220 and the ground plane either directly or via a passive circuit element. As shown in FIG. 4, for example, the first and second sets of shorting pins 212, 222 are arranged at substantially regular intervals along length l of the antenna 110. The single magnetic current may be supplied by a coaxial feed 240 with an inner conductor 214 and an outer conductor 224 electrically connected to the first conductor 210 and the second conductor 220, respectively. The first and second sets of shorting pins 212, 222 and the first and second conductors 210, 220 may be separated from the magnetic antenna by a distance. The distance may be substantially equal to the largest cross section of the first and second sets of shorting pins 212, 222 and the first and second conductors 210, 220, for example.

Previous solenoid feeds have significant phase delays, which lead to destructive interference. In order to reduce this phase shift interference, previous solenoid feed systems require complicated feed networks and/or elaborate matching circuits. However, the parallel solenoid feed system of the present disclosure distributes magnetic current excitation into a prescribed length of a magnetic dipole antenna 110 from a single feed point. Therefore, the parallel solenoid feed 200 eliminates the need for feed networks or matching circuits to reduce any phase shift interference in the antenna system.

Figure 10:
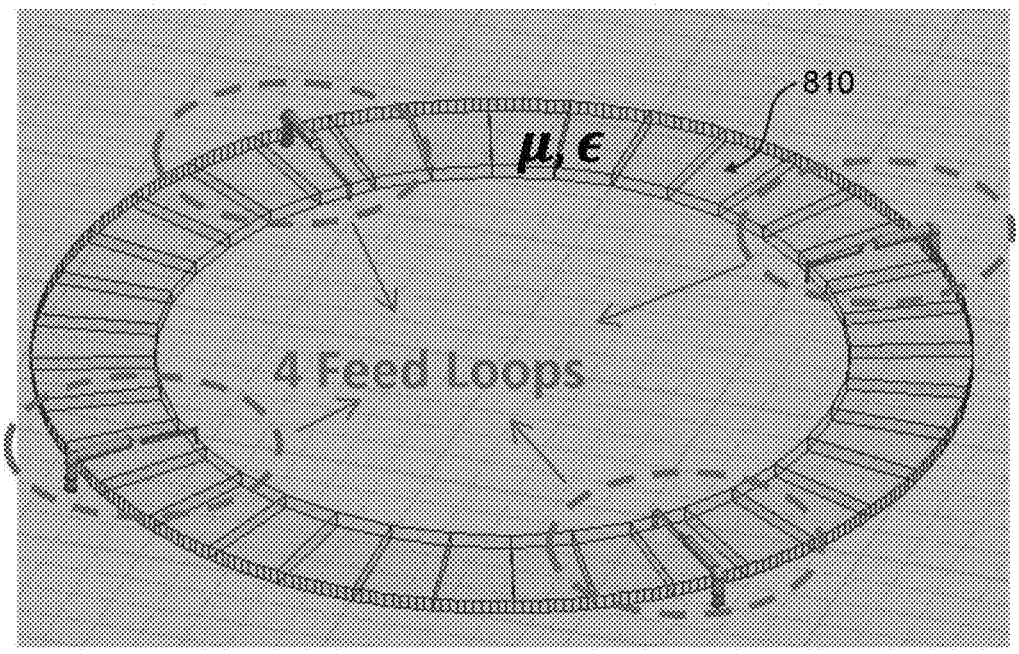
FIG. 10 is a schematic of a monopole mode of a magnetic current loop antenna with four feed loops.

In another non-limiting example, a circular magnetic antenna 810 having length l, width w, and height h, as shown in FIG. 10, may be excited by a parallel solenoid feed 900, as shown in FIG. 11. The parallel solenoid feed 900 includes four feed loops 940, although the number of feed loops 940 may vary in other antenna configurations. Each feed loop 940 supplies a magnetic current to a section of the circular magnetic antenna 810 through a first conductor 910 and a second conductor 920, which bisect the width w along the length l of the circular magnetic antenna 810. The feed 900 further includes a first set of shorting pins 912 and a second set of shorting pins 922 that connect the first and second conductors 910, 920, respectively, to the ground plane. As shown in FIG. 11, the first and second sets of shorting pins 912, 922 are arranged in groups that correspond to one of the feed loops 940. The feed loops 940 and the corresponding shorting pins 912, 922 are arranged at substantially regular intervals along the length l of the circular magnetic antenna 810.

As described in further detail below, the parallel solenoid feed 900 preserves the flux produced by a surrounding current loop inside the magnetic material of the antenna. Accordingly, the parallel solenoid feed 900 produces a higher peak gain and a higher realized gain than previous antenna feeds.

Disclosed are parallel solenoid feeds for magnetic antennas. The magnetic antenna may be constructed from a dispersive magnetic material, preferable having a relative permeability larger than the relative permittivity. For example, the absolute value of the permeability of the material may be significantly (e.g., at least three times) greater than the absolute value of the permittivity of the material.

The experimental results, described in detail below, illustrate the superior performance of the parallel solenoid feed of the present disclosure. In particular, the parallel solenoid feed was used in a linear magnetic current dipole antenna as well as a circular magnetic antenna, resulting in enhanced performance for both antenna types.

Use of the disclosed parallel solenoid feed systems in antennas, such as circular loop magnetic antennas, may enhance antenna performance by maintaining flux, which results in higher peak and realized gains. Any antenna with a contained flux specification may benefit from using a properly designed parallel solenoid feed system of the present disclosure. The methods for using a parallel solenoid feed disclosed herein can tailor the current distribution and optimize the efficiency of any true magnetic antenna with permeable magnetic material and a magnetic current in a permeable channel. Therefore, the parallel solenoid feed systems may be easily incorporated into the design and production of antennas, using full wave simulations from available software, such as HFSS or CST, to determine the number or solenoid bars needed in a particular antenna to maintain flux, while allowing the wave to radiate easily, that is, without overly-tight wave binding.

EXAMPLES

The following Examples are provided in order to demonstrate and further illustrate certain embodiments and aspects of the present invention and are not to be construed as limiting the scope of the invention.

Example 1

The following section details the results and protocol undertaken to show the effect of the solenoid feed with a permeable magnetic dipole antenna 110 that has a length l of 1 m, a height h of 0.25", and a width w of 2.5", as shown in FIG. 3. The permeable material used was Bekaert's CZN (Cobalt Zirconium Niobium alloy) laminates.

FIG. 3 shows a magnetic dipole antenna with multiple electric loop feeds. Previously, ferrite rod antennas were fed with a solenoid having many turns. An issue with such a configuration, especially at high frequencies, is that since the feed current wire is wound on the ferrite, there is a considerable amount of phase delay when moving away from the feed source point. Therefore, the feed excites magnetic currents in the magneto-dielectric material, which cancel each other when out of phase. To compensate for this phase shift interference, a parallel feed configuration of multiple feed loops may be required, which in turn needs a feed network consisting of splitters and/or hybrids. The parallel solenoid feed of the present disclosure solves this issue without the need for complex feed networks or matching circuits. Despite the need for multiple feeds for suppressing higher order modes and maintaining structural symmetry in some antenna configurations, such as circular magnetic antennas, for example, the following results show that using the parallel solenoid feed in linear dipoles eliminates the need for multiple feeds.

Figure 4A:
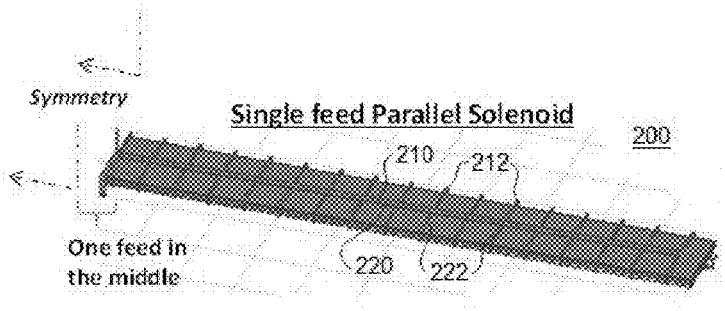
FIG. 4A is a schematic of an antenna structure with a parallel solenoid feed, in accordance with the present disclosure.
Figure 4B:
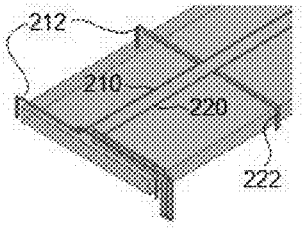
FIG. 4B is an enlarged view of the antenna of FIG. 4A, in accordance with the present disclosure.
Figure 4C:
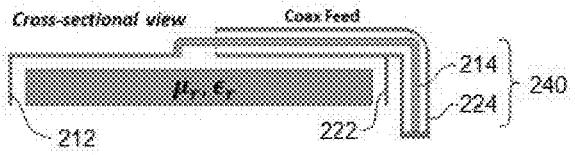
FIG. 4C is a cross-sectional view of the antenna of FIGS. 4A-B, in accordance with the present disclosure.

FIGS. 4A-C show a parallel solenoid feed as disclosed herein. Previous solenoids wind only one conductor (that is, the center conductor in a coaxial feed) in series. In the parallel solenoid feed, the inner and outer conductor of the coaxial feed are stretched to the ends of the material with grounded shorting pins at regular intervals. This configuration fixes the issue of the considerable phase delay present in previous solenoid feeds.

Figure 4D:
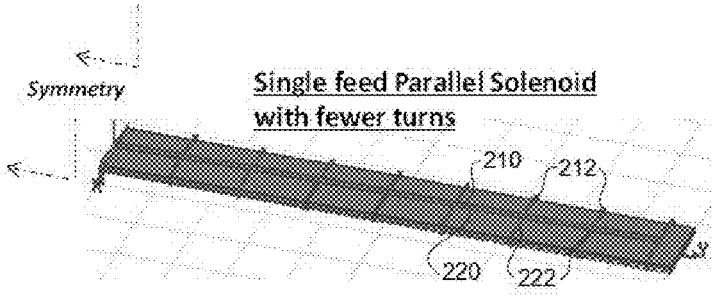
FIG. 4D is a schematic of a dipole antenna with a parallel solenoid feed with reduced turns, in accordance with the present disclosure.

FIG. 4A shows an antenna structure with a parallel solenoid feed, FIG. 4B is an enlarged view of the antenna of FIG. 4A near the feed port of the antenna structure, and FIG. 4C is a cross-sectional view of the antenna of FIGS. 4A-B. It should be noted that the parallel solenoid feed structure may be further simplified by eliminating the extra 90° bends that are shown in FIG. 4A. FIG. 4D shows a dipole antenna with a parallel solenoid feed and fewer turns than in the structures of FIGS. 4A-C.

In this example experiment, the antenna configuration of FIG. 4A is compared with both an antenna with a single loop feed located at its center and with an antenna with three feeds, as shown in FIG. 3. Additional testing was performed using a fourth antenna configuration with a parallel solenoid feed and fewer turns as shown in FIG. 4D.

Figure 5A:
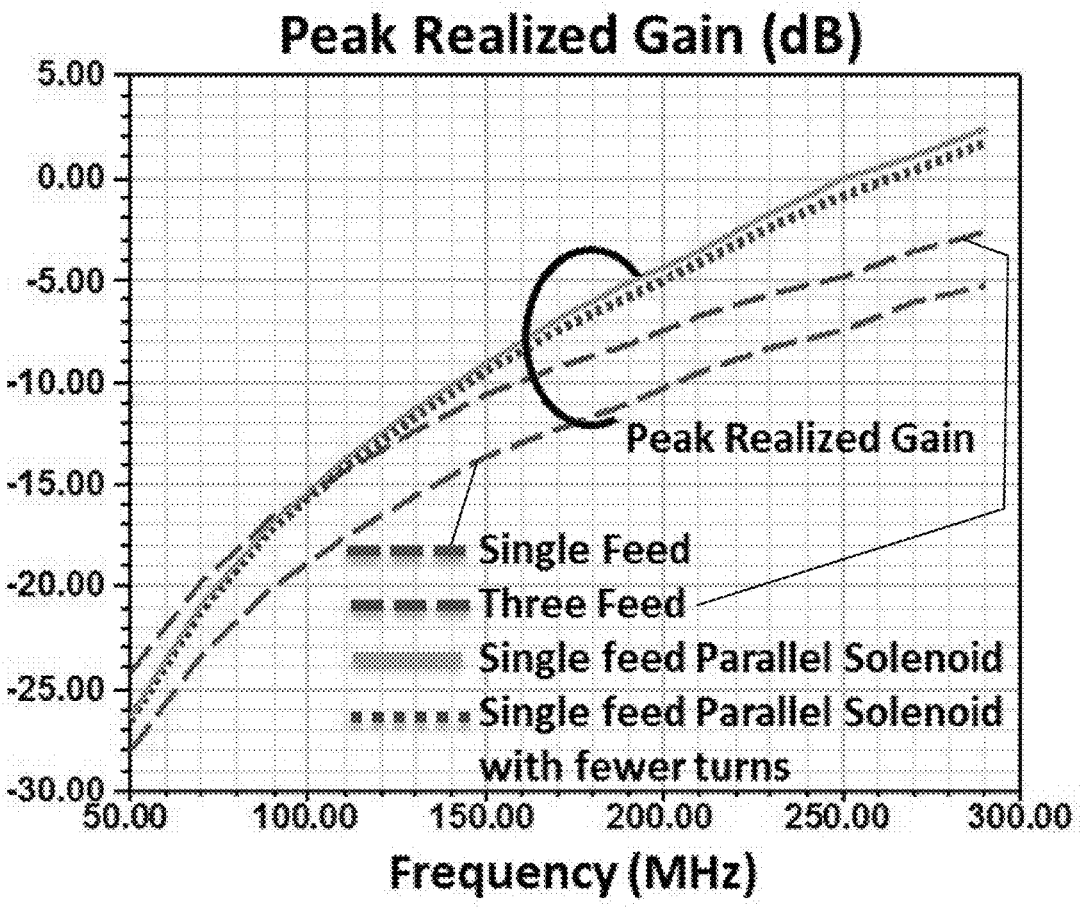
FIG. 5A is a graph of peak realized gain versus frequency for four antenna configurations tested in Example 1, in accordance with the present disclosure.
Figure 5B:
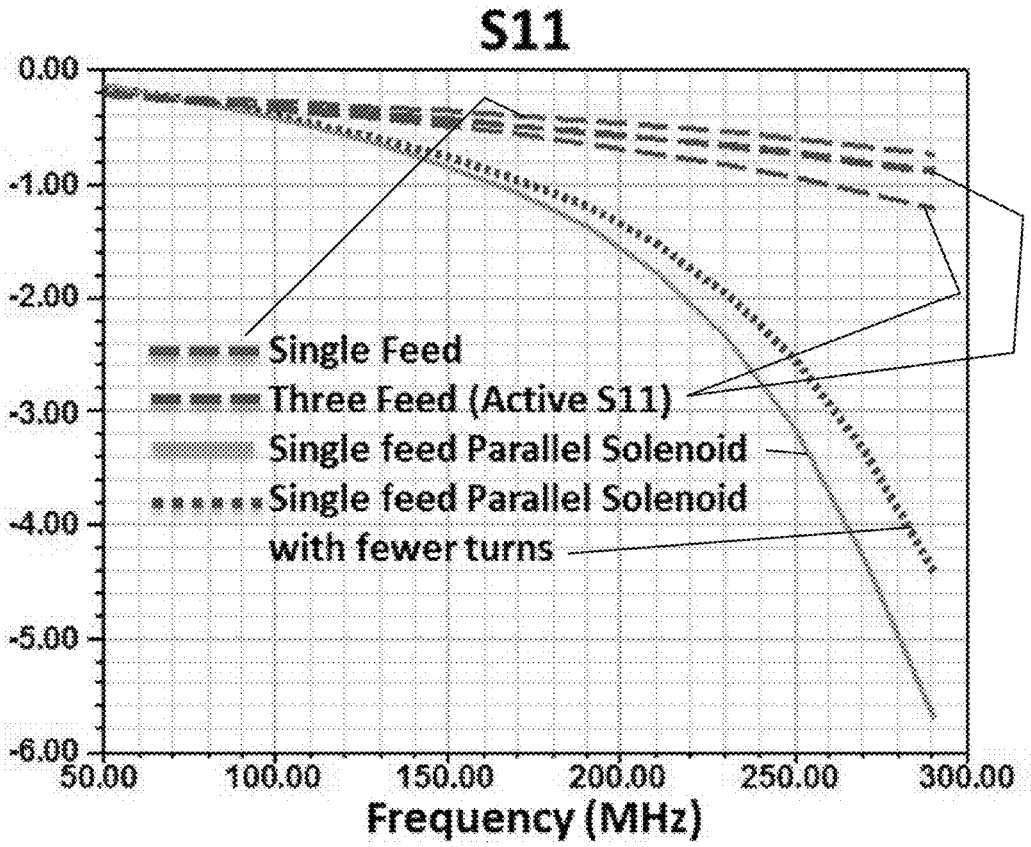
FIG. 5B is a graph of $S_{11}$ (reflection coefficient) versus frequency for four antenna configurations tested in Example 1, in accordance with the present disclosure.

FIGS. 5A-B show the results of the comparison of the peak realized gain and $S_{11}$ of the four different antenna configurations across a frequency band from about 50 MHz to about 300 MHz. The red dashed curve is the antenna configuration with a single feed, the green dashed curve is the antenna configuration with three feeds, the orange solid curve is the antenna configuration with a single parallel solenoid feed, and the blue dotted curve is the antenna configuration with a single parallel solenoid feed having reduced turns. Note that in the case of the antenna with a three loop parallel feed, the active $S_{11}$ at the individual port is what is plotted in FIG. 5B.

The peak realized gain of the single feed is shown by the red curve on the graph and is the lowest. It can be seen with the green curve that adding two additional feed loops improved the peak realized gain. The graph shows that the parallel solenoid feed gives a considerably better realized gain over the whole band that was simulated. Finally, the $S_{11}$ antenna using the parallel solenoid feed gave the best results of all for peak realized gain. Thus, the single loop fed parallel solenoid, without any additional matching circuit, performed better than the antennas with a single loop feed and a three parallel loop feed.

Reducing the number of shorting pins in the parallel solenoid feed had little effect on its gain performance in this case. However, too many pins can cause over binding of the current, so it is important to find the right balance of shorting pins.

Figure 6:
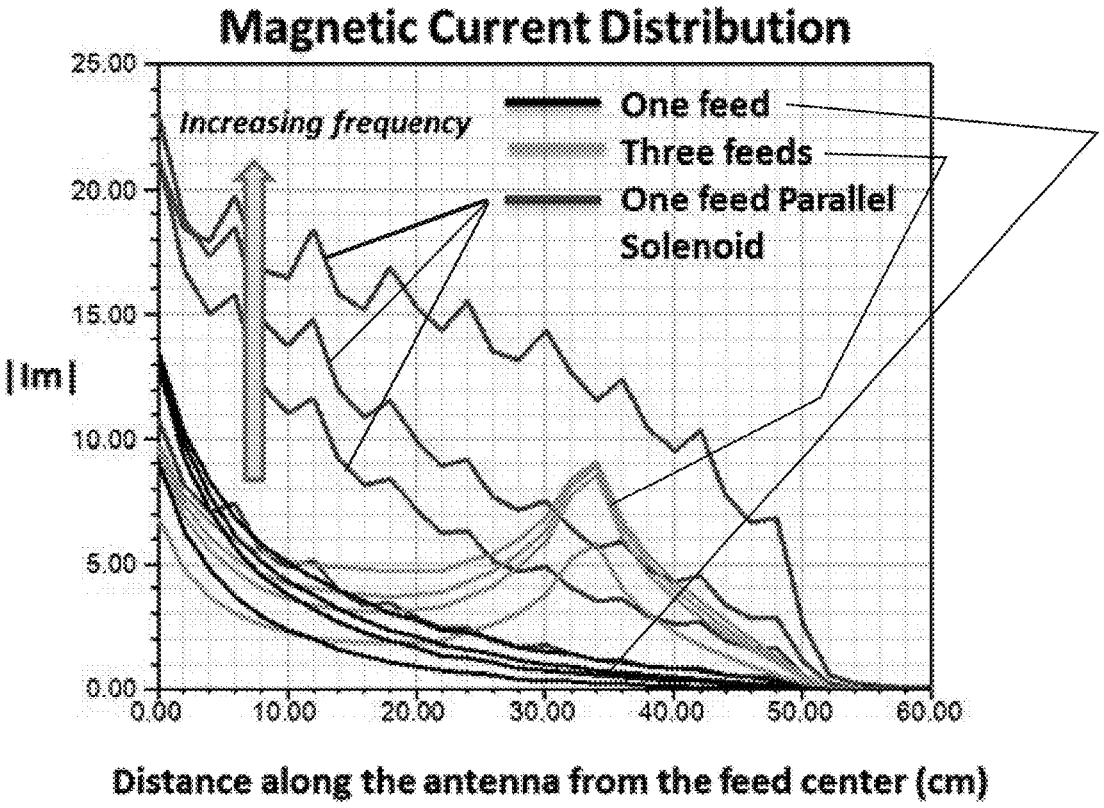
FIG. 6 is a graph of magnetic current distribution versus distance from feed center for four antenna configurations tested in Example 1, in accordance with the present disclosure.

The improved performance of the antenna with a parallel solenoid feed can be explained by looking at the magnetic current distribution for the antennas. FIG. 6 shows the magnetic current distribution in the dipole for the antennas with one feed, three feeds, and a parallel solenoid feed.

FIG. 6 shows a graph comparing the magnetic current distribution of the four different antenna configurations. As seen in FIG. 6, the blue curve results of the parallel solenoid feed shows that it draws more magnetic current than the other two antennas at every frequency close to the feed. Additionally, the current distribution for the parallel solenoid feed is considerably more uniform than the single feed case. Because of this uniformity, the resulting gain and peak realized gain is considerably higher for the parallel solenoid feed when compared with antennas using previously known solenoid feeds.

Figure 7:
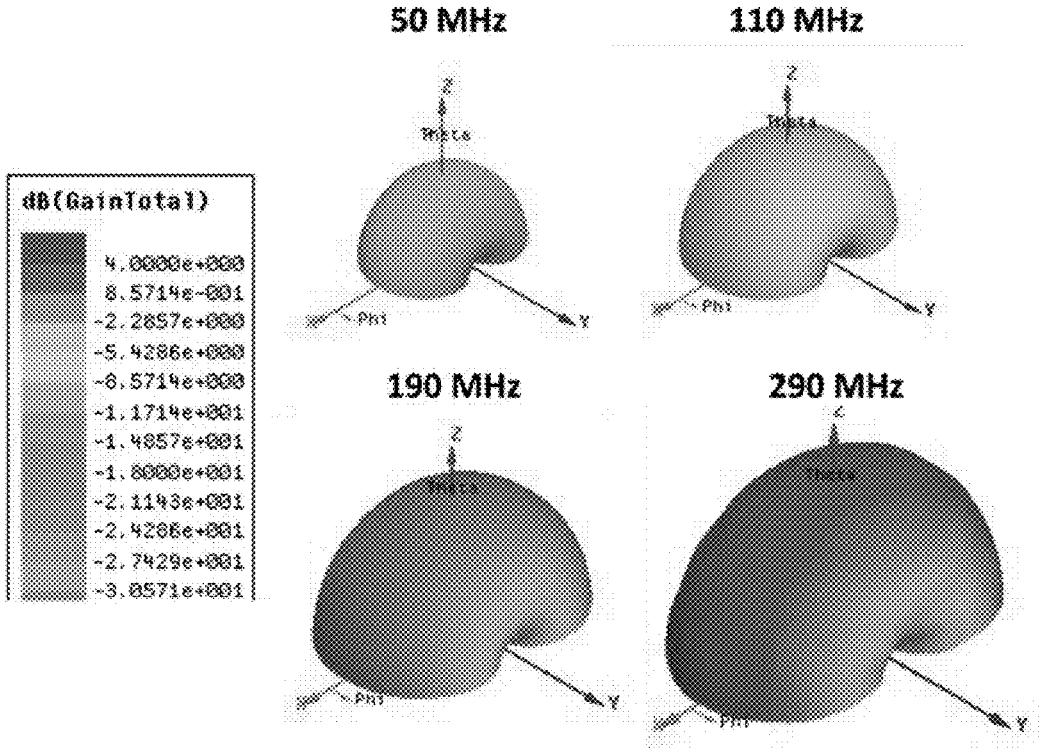
FIG. 7 is a three-dimensional polar plot of the total gain at different frequencies for a magnetic current dipole antenna with a parallel solenoid feed as tested in Example 1, in accordance with the present disclosure.

FIG. 7 shows a three-dimensional polar plot of the total gain at different frequencies for the magnetic current dipole antenna with the parallel solenoid feed. As seen in FIG. 7, the dipole radiation pattern has a donut shape with the antenna aligned along the y-axis.

Figure 8:
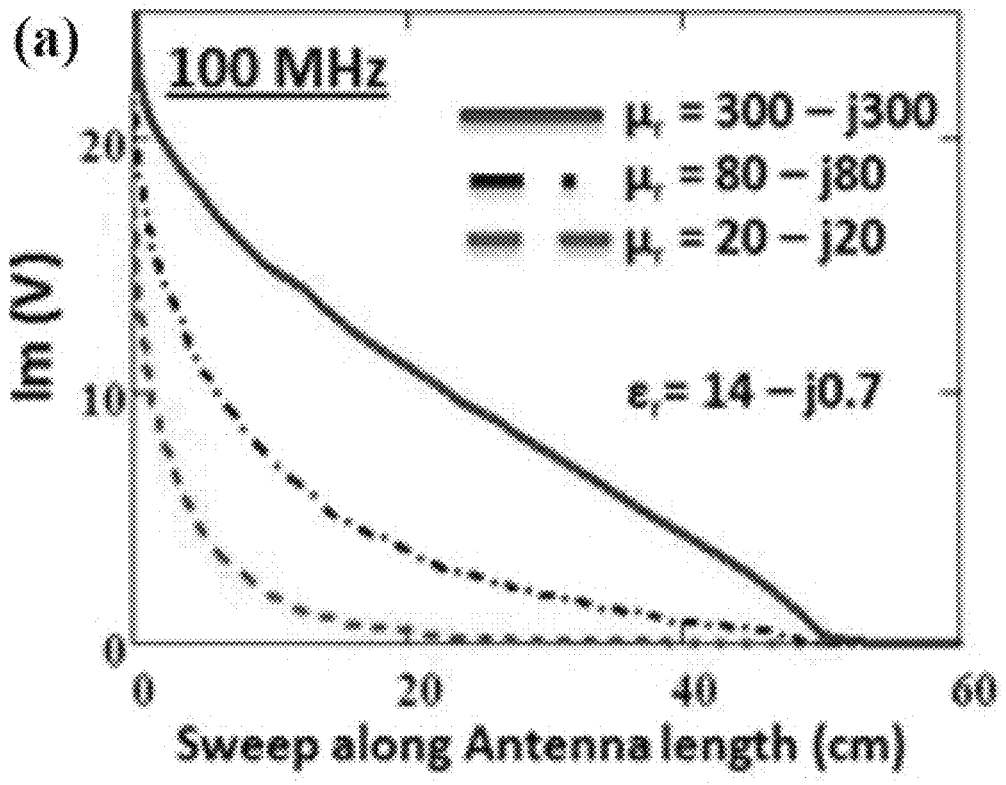
FIG. 8 is a graph of current distribution versus distance from feed center for a dipole antenna with a single feed as tested in Example 1, in accordance with the present disclosure.

The experimental results further show that the parallel solenoid feed helps contain the magnetic current in a linear dipole. Specifically, a 1 meter long magneto-dielectric dipole was simulated. The magnetic current distribution along the dipole length for the antenna with a single feed loop is shown in FIG. 8. The graph in FIG. 8 shows that the permeability has to be as high as 300 in order to attain a triangular current distribution. For lower permeabilities, the magnetic current decays in an exponential manner when moving away from the feed along the dipole length.

Figure 9:
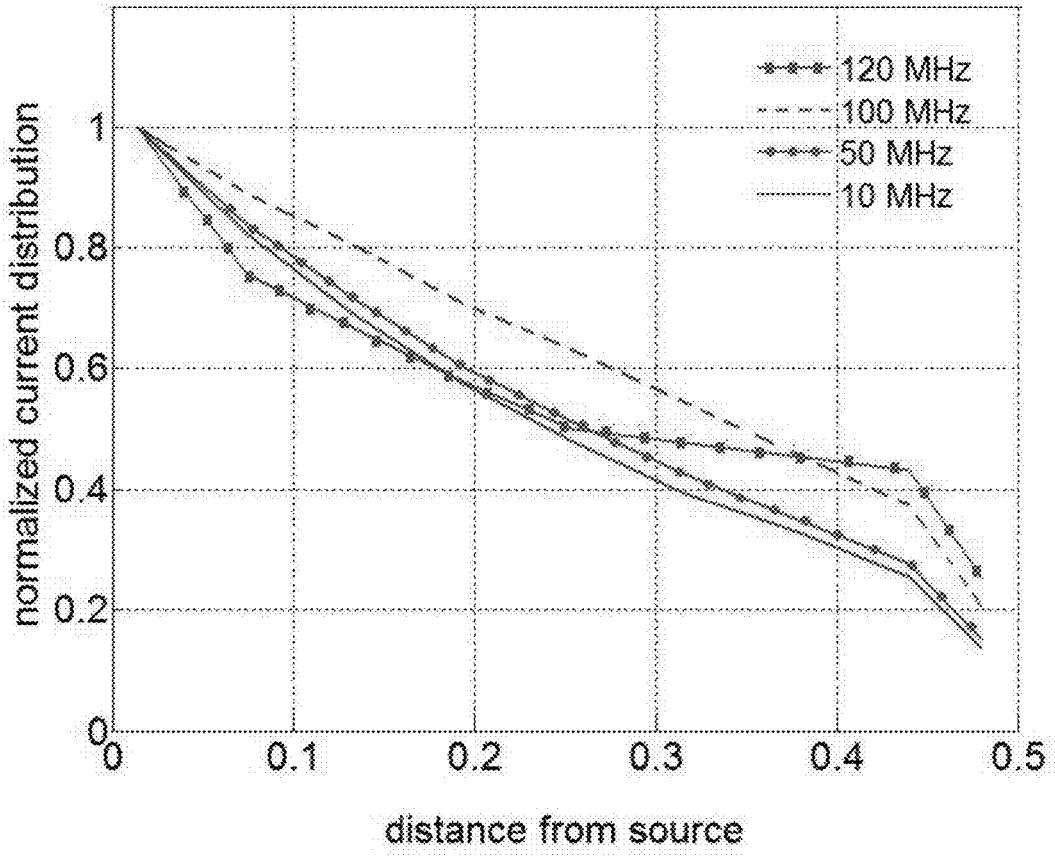
FIG. 9 is a graph of current distribution versus position for an antenna with a parallel solenoid feed as tested in Example 1, in accordance with the present disclosure.

FIG. 9 shows a plot of the normalized current distribution at different frequencies versus the distance from the source for a laminate material with $\mu$=40 on an antenna with a parallel solenoid feed having loops spaced 3 cm apart. As seen in FIG. 9, across the various frequencies, the results exhibit a triangular current distribution. However, the flux does not go to zero because of the parallel solenoid cage. By using the laminate material with $\mu$=40 and the parallel solenoid feed, the triangular current distribution is maintained in the antenna down through a frequency of 10 MHz. Therefore, the parallel solenoid feed configuration advantageously contains the magnetic current.

Example 2

In Example 2, a parallel solenoid feed for the monopole mode of a magnetic current loop was tested. Specifically, the effect of the parallel solenoid feed on antenna performance was studied for a linear magnetic dipole. It was found that when a parallel solenoid feed or cage is added to a circular magnetic antenna, the parallel solenoid cage helps the electromagnetic wave stay within the magnetic material.

In order to operate an antenna up through high frequencies, the excitation of higher order mode current distributions needs to be suppressed, such as in the case of a circular magnetic antenna, for example. The suppression of higher order modes generally requires multiple feed loops. In previous antenna configurations, the magnetic current is injected at four feed points to suppress the excitation of higher order modes, as can be seen in FIG. 10, which shows a schematic of a monopole mode of a magnetic current loop with four feed loops.

FIG. 11 shows a schematic of a monopole mode of a magnetic current loop with four feed loops and a parallel solenoid cage with 16 solenoid bars. As shown in FIG. 11, a parallel solenoid feed also uses multiple feeds. However, the parallel solenoid cage distributes the feed current over wider feed regions of the loop, which prevents leakage and ensures that all the material available contributes to radiation. As seen in FIG. 11, the multiple loops are connected to each other by a curved transmission line. The width of the transmission line conductors and the separation between them as well as the width of the loops are all adjustable parameters.

The exact spacing and dimensions of the solenoid bars may depend on the specific design of the antenna being used. However, the nominal spacing $d_0$ between the solenoid bars for enhancing antenna performance with the parallel solenoid feed, according to the present disclosure, can be determined by the following equation:

$$d_0=2\overline{r_{cs}}$$

where $\overline{r_{cs}}$ is a mean cross-sectional radius of a magnetic antenna, which is multiplied by a factor of 2 to account for the image in the ground plane. The mean cross-sectional radius of a magnetic antenna is defined by the equation:

$$\overline{r_{cs}} = \sqrt[2]{\frac{A}{\pi}}$$

where A is an effective area of a magnetic antenna including the image in the ground plane. For example, a magnetic antenna, 2.5" wide, 0.25" thick, and mounted on a ground plane, has an effective area of $(2.5\times0.25)\times2$ in$^2$, giving a mean cross-sectional radius of 0.63". Thus, the nominal spacing of the solenoid bars is 1.26"+50%. As another example, a magnetic antenna, 3" wide, ⅔" thick, and mounted on a ground plane, has an effective area of $(3\times\frac{2}{3})\times2$ in$^2$, giving a mean cross-sectional radius of 1.13", which results in a nominal spacing for the solenoid bars of 2.26"±50%. This relationship is based on magnetostatics' preservation of flux produced by a surrounding current loop inside magnetic material when an antenna is sufficiently electrically small such that the flux distribution may be determined from quasi-static considerations.

Although these nominal calculations may be a proper starting point, it will be understood by those in the art that if the permeability of the magnetic antenna material is very high, the solenoid bars may be spaced farther apart. This increased spacing configuration may be preferable due to the material's extremely low reluctance path for the flux, which becomes its preferred channel.

Alternatively, if the permeability of the magnetic antenna material is very low, the solenoid bars may be spaced closer together. This decreased spacing configuration may be preferable due to the material's higher reluctance allowing the flux to leak into the surrounding space. However, cases with magnetic material of very low permeability (i.e., $\mu\sim1$) are not of interest because of the absence of a radiating magnetic displacement current and the antenna no longer being a magnetic current radiator. Still, the very low permeability cases establish a lower limit value for the spacing of the solenoid bars in the parallel solenoid feed. The lower limit for the solenoid bar spacing is on the order of one mean cross-sectional radius. This is based on the nearly uniform magnetic fields that exist in empty spaces between electric current carrying loops in Helmholtz coils with a spacing of one mean cross-sectional radius.

Leakage flux calculations for previously known magnetic circuits may advantageously be used to make spacing determinations for a particular parallel solenoid feed installation. The benefits of using a parallel solenoid feed, as disclosed herein, on an antenna are that the parallel solenoid feed not only maintains a uniform magnetic current through the antenna, but also enables broad band operation. The enhanced broad band performance is possible through exploiting the large gain bandwidth which is created within such antennas. When moving into higher frequencies, the surface wave guidance frequency appropriate for the material's cross-section is approached, and wave effects, such as phase delay, become increasingly important. Because of these two characteristics, the final design of the parallel solenoid feed, including the solenoid bar spacing, is preferably developed using full physics (i.e., full-wave) solutions of the particular antenna.

Figure 12A:
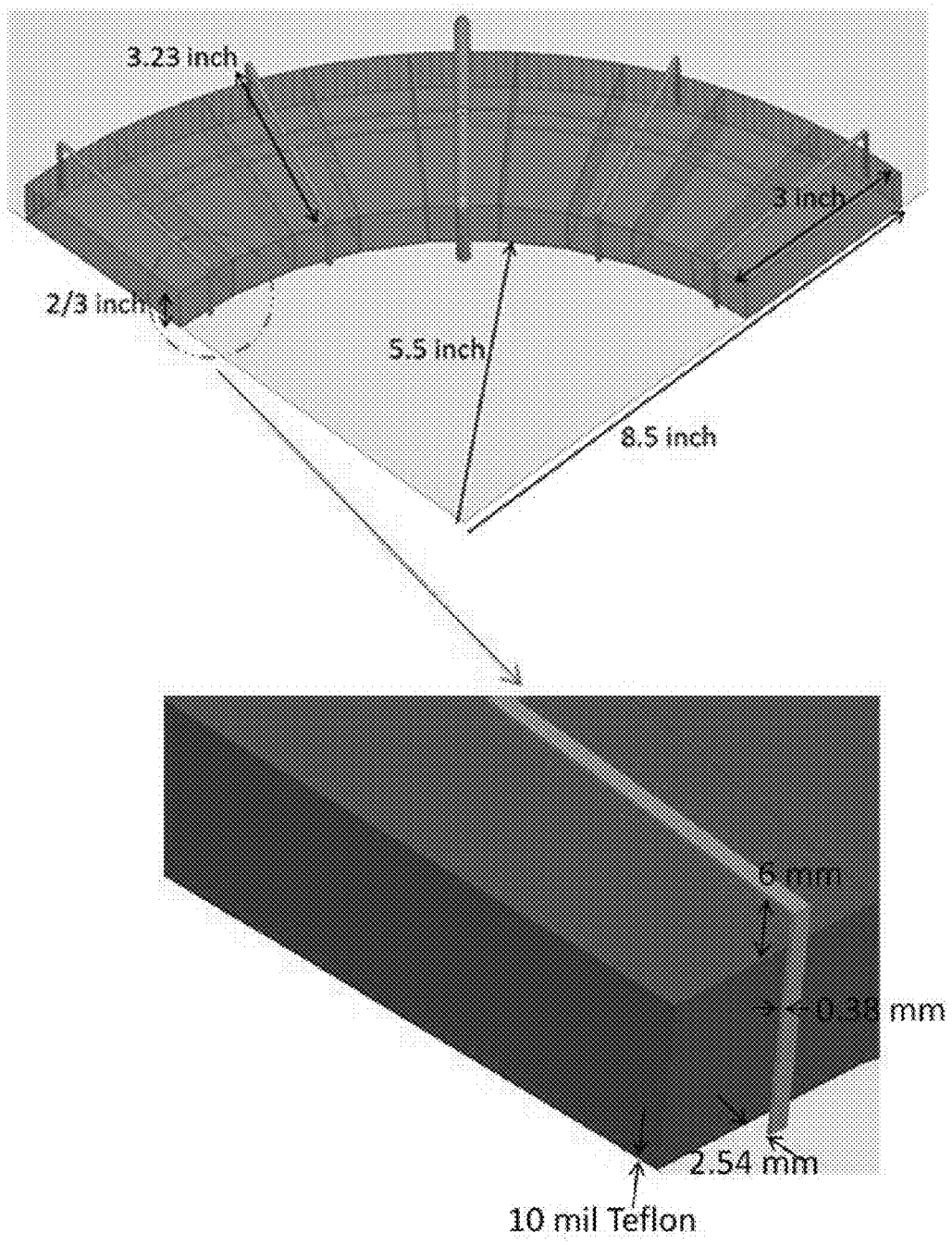
FIG. 12A is a schematic of a quarter of a circular magnetic antenna employing a parallel solenoid feed, in accordance with the present disclosure.
Figure 12B:
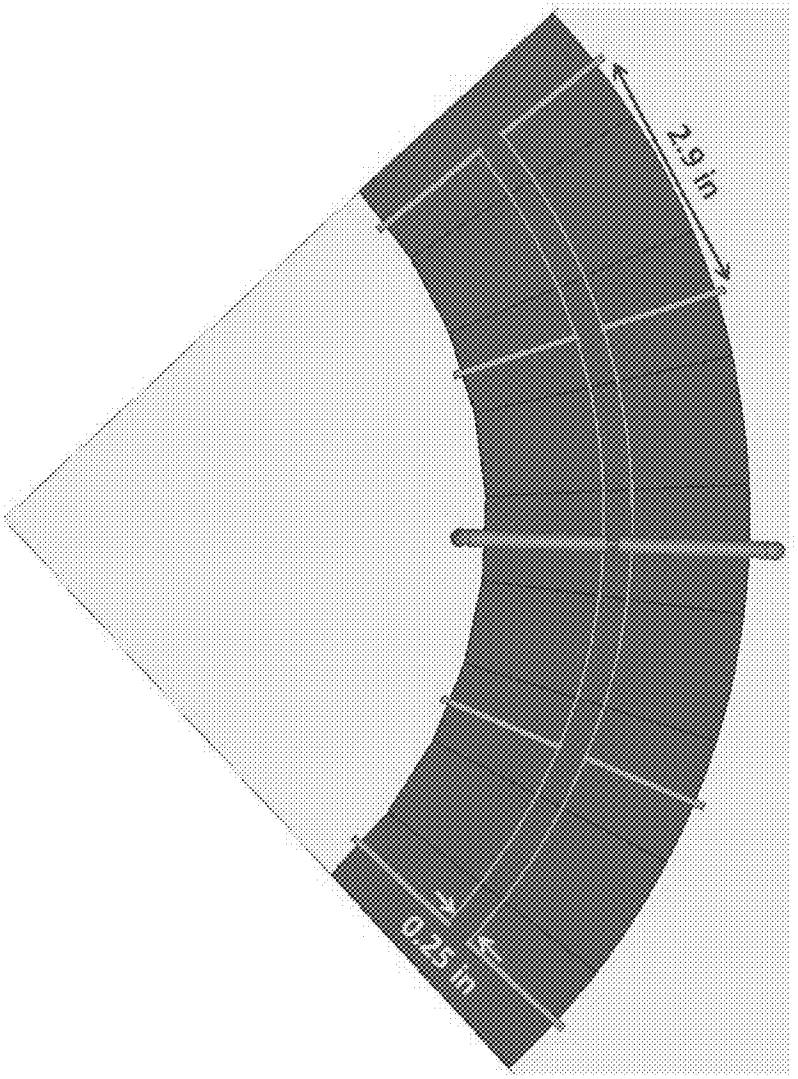
FIG. 12B is a top view of the circular magnetic antenna of FIG. 12A, in accordance with the present disclosure.

FIG. 12A is a schematic of a quarter of a circular magnetic antenna employing a parallel solenoid feed. FIG. 12A includes a magnified view of the magnetic circular antenna with a parallel solenoid feed. FIG. 12B is a top view of the circular magnetic antenna of FIG. 12A.

Figure 13:
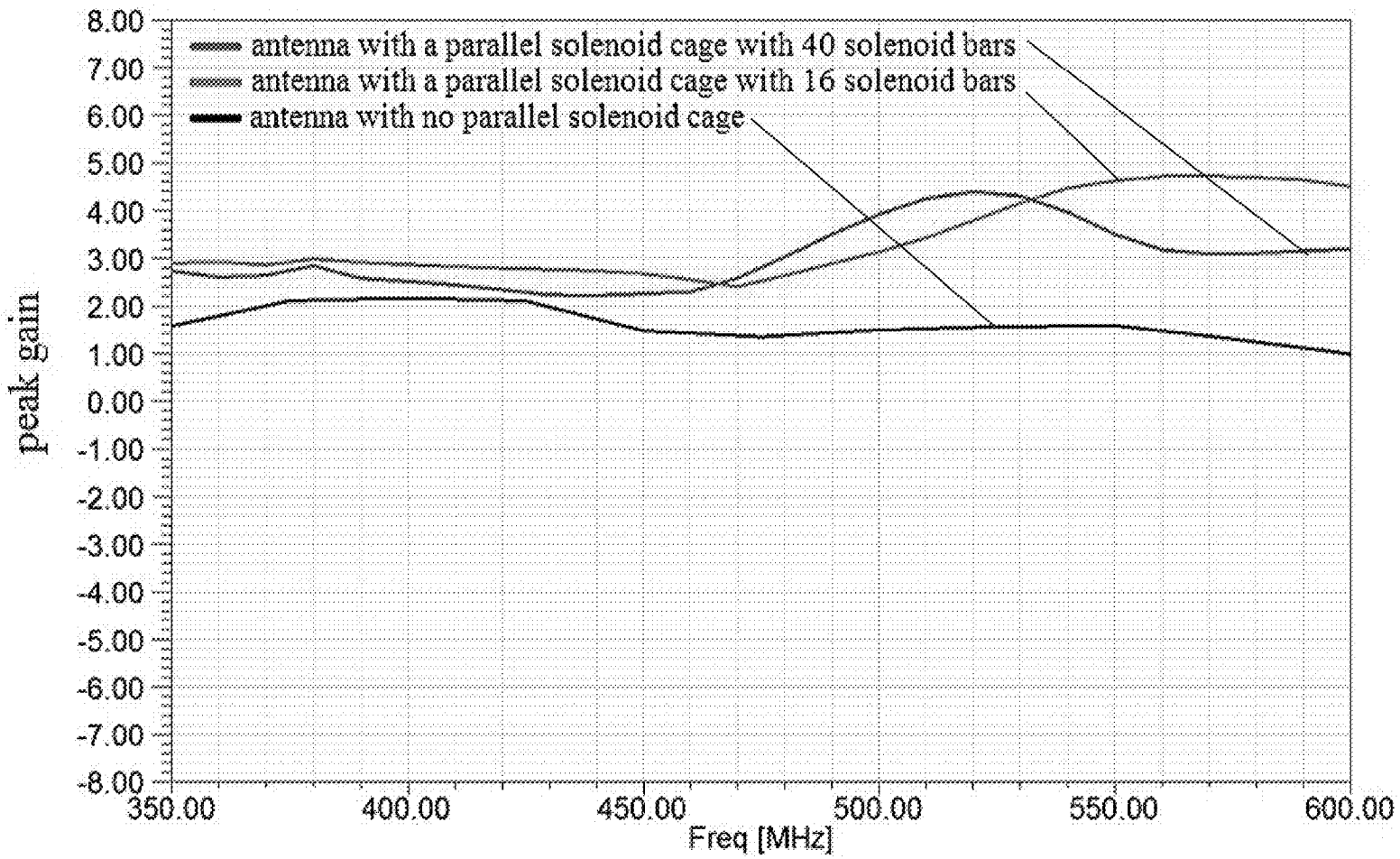
FIG. 13 is a graph of peak gain versus frequency for three antenna configurations tested in Example 2, in accordance with the present disclosure.
Figure 14:
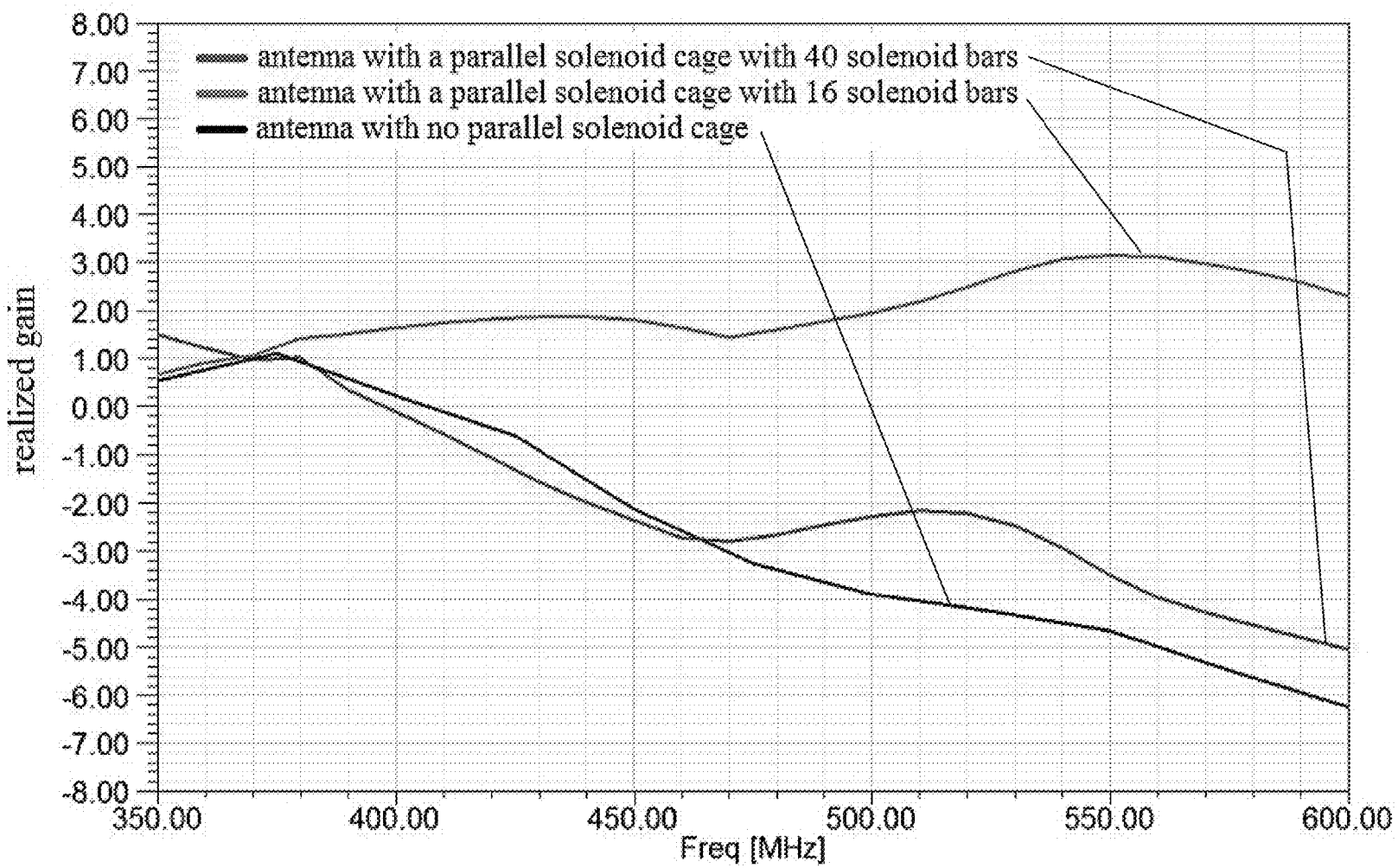
FIG. 14 is a graph of realized gain versus frequency for three antenna configurations tested in Example 2, in accordance with the present disclosure.

Another parameter to consider when determining the final design of a circular magnetic antenna with a parallel solenoid feed is the number of solenoid bars in the parallel solenoid feed. A small number of solenoid bars leads to wave leakage from the material, and a large number of solenoid bars leads to overly-tight wave binding that prevents easy radiation. The adjustable parameters may include, but are not limited to, the number of solenoid bars, the width of the transmission line conductors connecting the solenoid bars, and the spacing between the solenoid bars. As shown in FIG. 13, the peak gain of the circular magnetic antenna with a parallel solenoid cage having 16 or 40 solenoid bars is higher than an antenna without a parallel solenoid cage. The graph of FIG. 14 shows that varying the number of solenoid bars affects the highest realized gain in a specific frequency band. These results show that the antenna with a parallel solenoid cage with 16 solenoid bars gave the highest realized gain.

Figure 15:
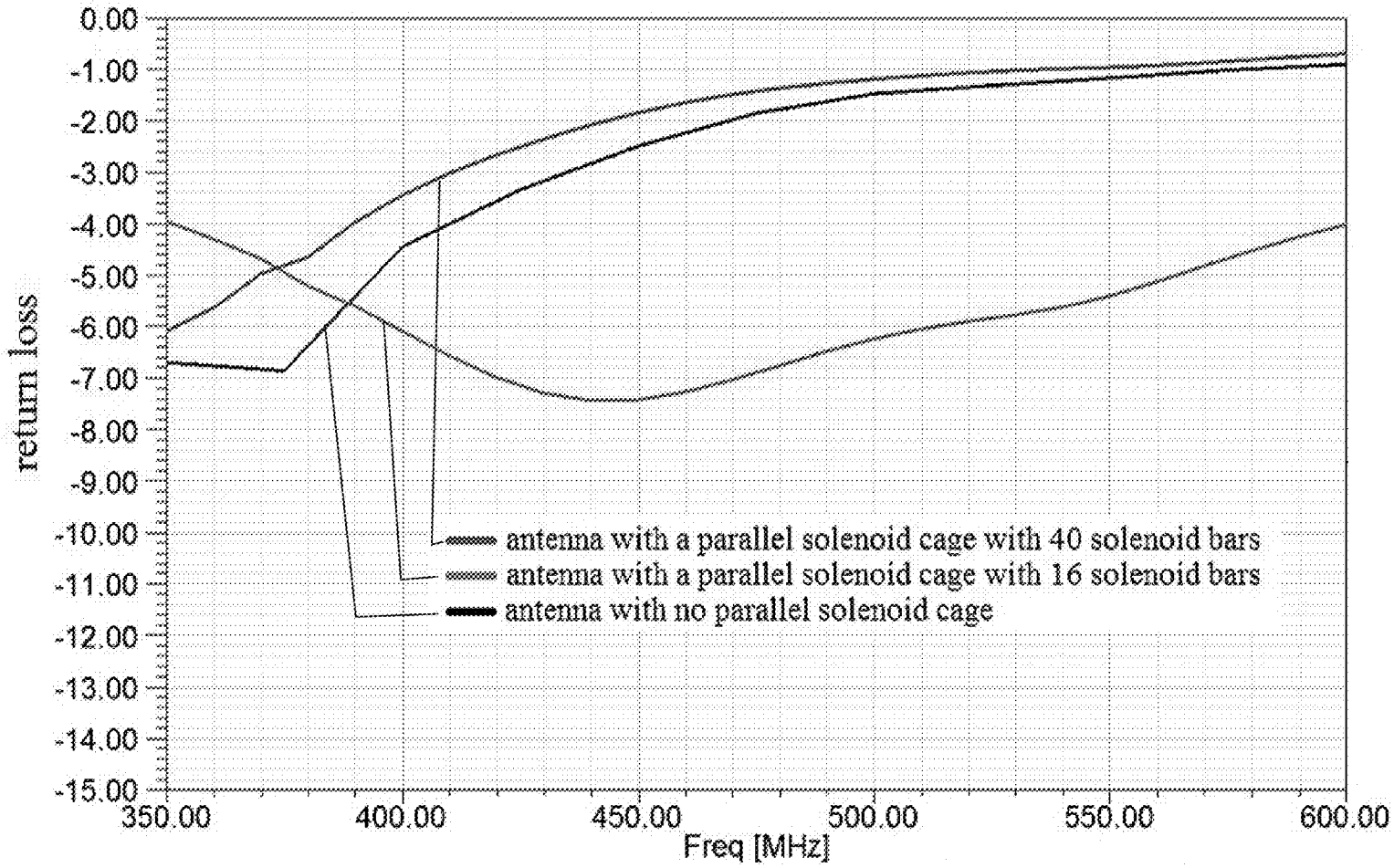
FIG. 15 is a graph of return loss versus frequency for three antenna configurations tested in Example 2, in accordance with the present disclosure.

FIGS. 13-15 show graphs of the peak gain, realized gain, and return loss of the monopole mode of antennas with four feed loops across a frequency band from 350 MHz to 600 MHz. The red curve is an antenna with a parallel solenoid cage with 40 solenoid bars, the blue curve is an antenna with a parallel solenoid cage with 16 solenoid bars, and the black curve is an antenna with no parallel solenoid cage.

Figure 16:
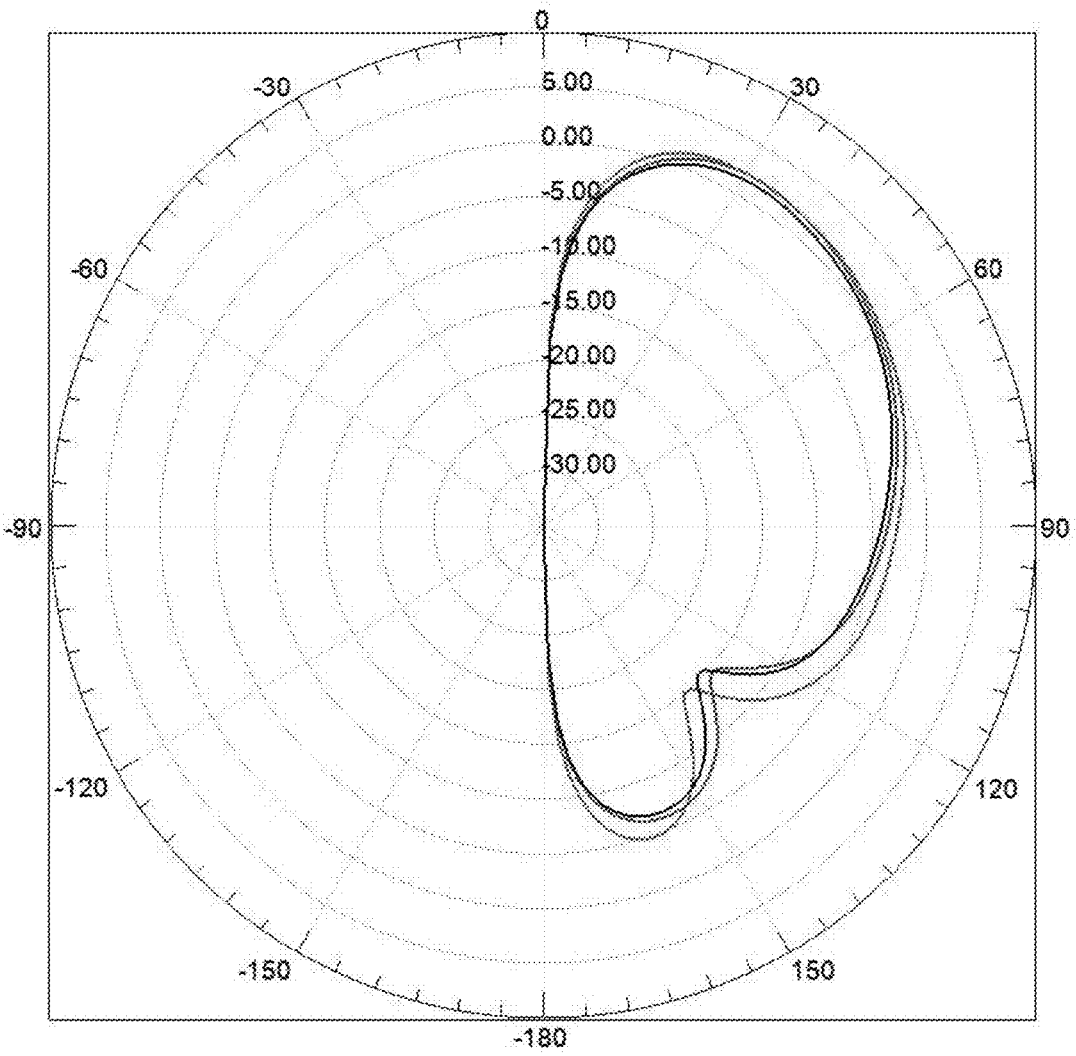
FIG. 16 is a plot of radiation pattern versus θ for three antenna configurations tested in Example 2, in accordance with the present disclosure.

As can be seen from FIG. 15, the number of solenoid bars may be used as a tuning aid in order to advantageously achieve a better return loss. FIG. 16 is a plot of radiation pattern versus θ of the monopole mode of the three antennas of FIGS. 13-15 at 420 MHz with $\varphi=0°$.

Example 3

In Example 3, a parallel solenoid feed for the dipole mode of a magnetic current loop was tested in a similar manner as in Example 2.

Figure 17:
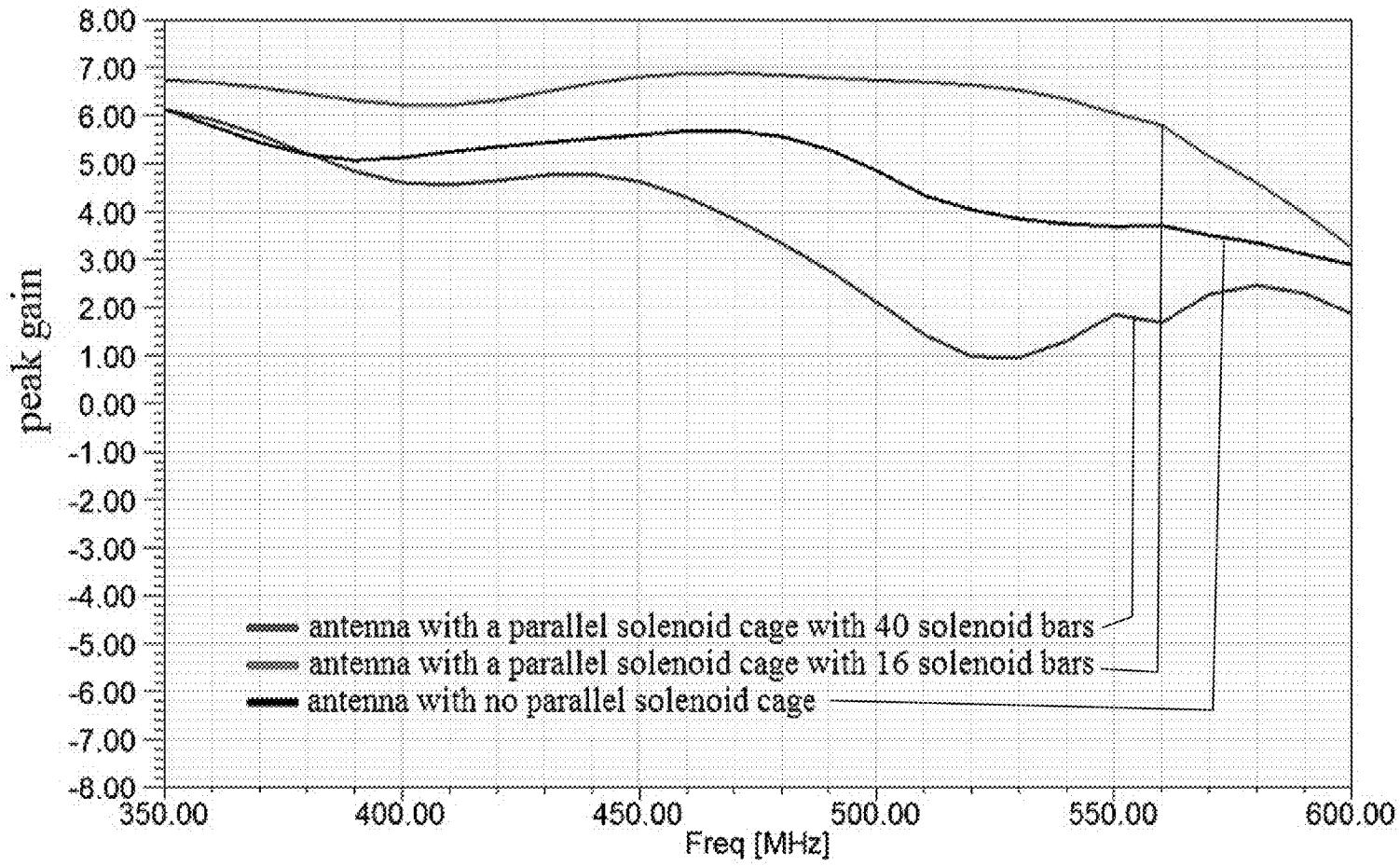
FIG. 17 is a graph of peak gain versus frequency for three antenna configurations tested in Example 3, in accordance with the present disclosure.
Figure 18:
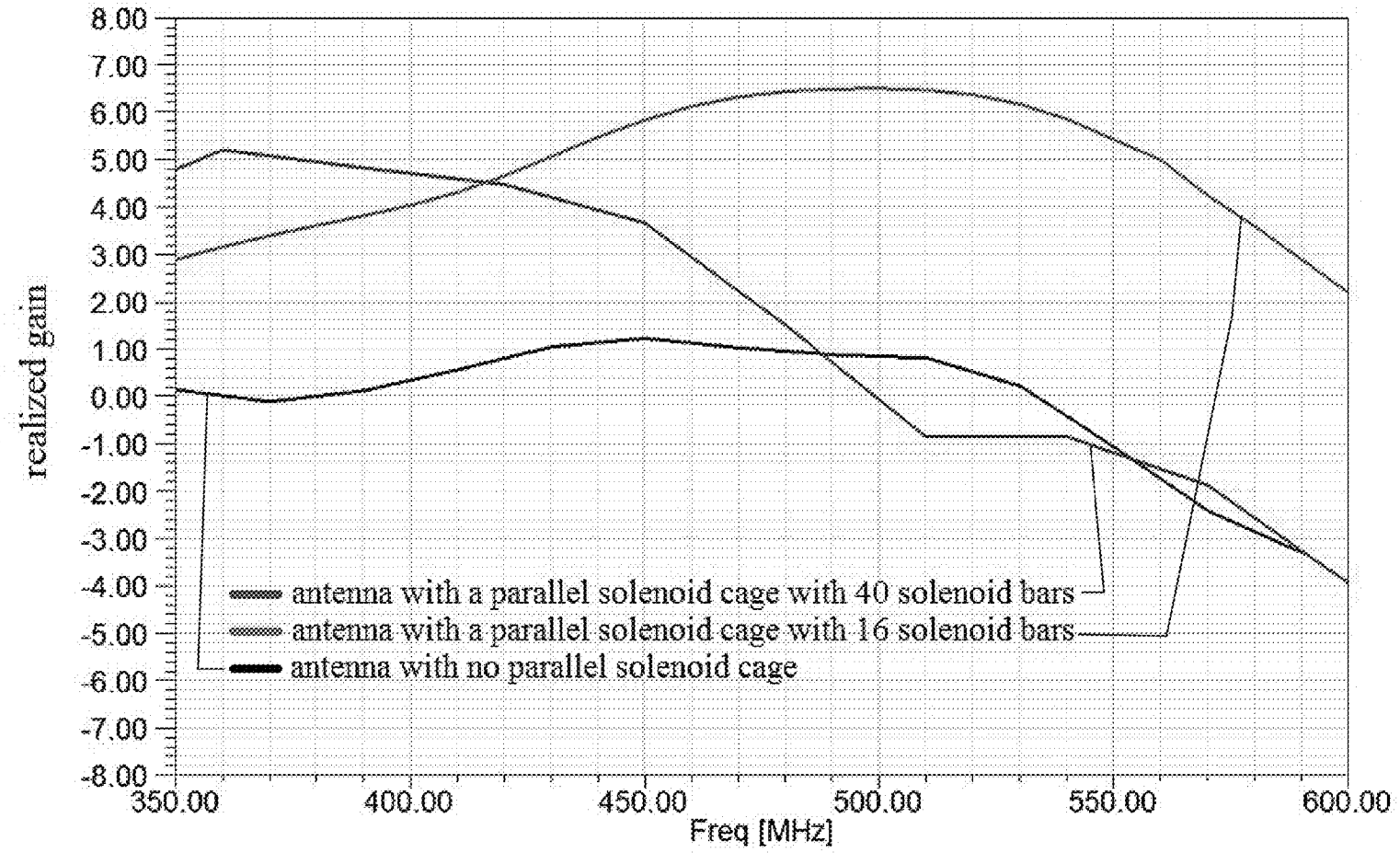
FIG. 18 is a graph of realized gain versus frequency for three antenna configurations tested in Example 3, in accordance with the present disclosure.

As shown previously in Example 2, the peak gain and realized gain for three antenna configurations were tested. FIGS. 17-18 show graphs of the peak gain and realized gain of the dipole mode of antennas with four feed loops across a frequency band from about 350 MHz to about 600 MHz.

The red curve is an antenna with a parallel solenoid cage with 40 solenoid bars, the blue curve is an antenna with a parallel solenoid cage with 16 solenoid bars, and the black curve is an antenna with no parallel solenoid cage.

As seen from FIGS. 17-18, the peak gain and realized gain of the antenna with a parallel solenoid cage having 16 solenoid bars are higher than the other two antenna configurations. As with the monopole mode, the number of solenoid bars and the widths of varying parts of the parallel solenoid cage may be used as adjustable parameters to tune the peak and realized gain for the dipole mode.

Figure 19:
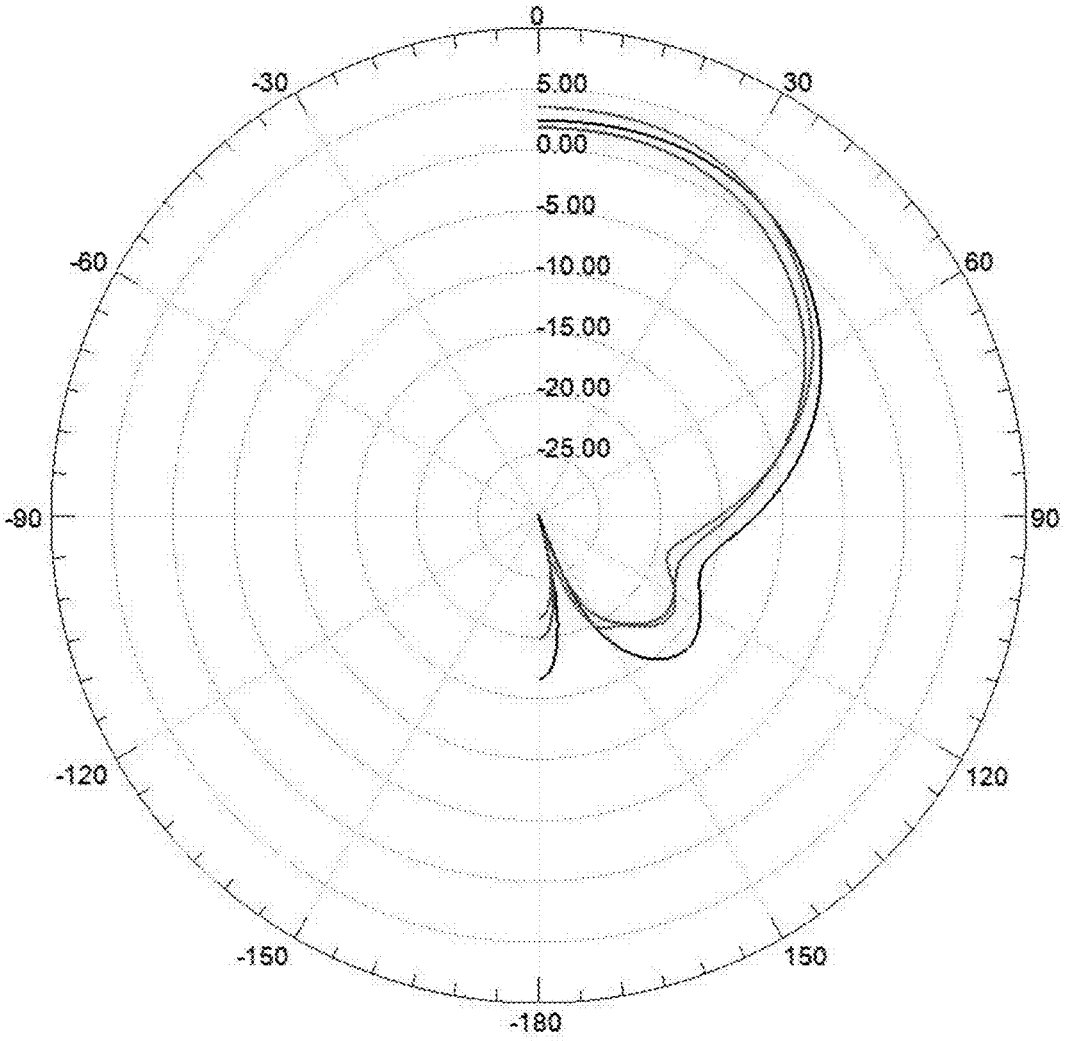
FIG. 19 is a plot of radiation pattern versus θ for three antenna configurations tested in Example 3, in accordance with the present disclosure.

It can be seen from FIG. 18 that the realized gain achieved when using a parallel solenoid cage, in accordance with the present disclosure, is higher than using an antenna configuration with only four feed loops and no parallel solenoid cage. FIG. 19 is a plot of radiation pattern versus θ of the dipole mode of the three antennas of FIGS. 17-18 at 420 MHz with φ=45°.

Figure 20:
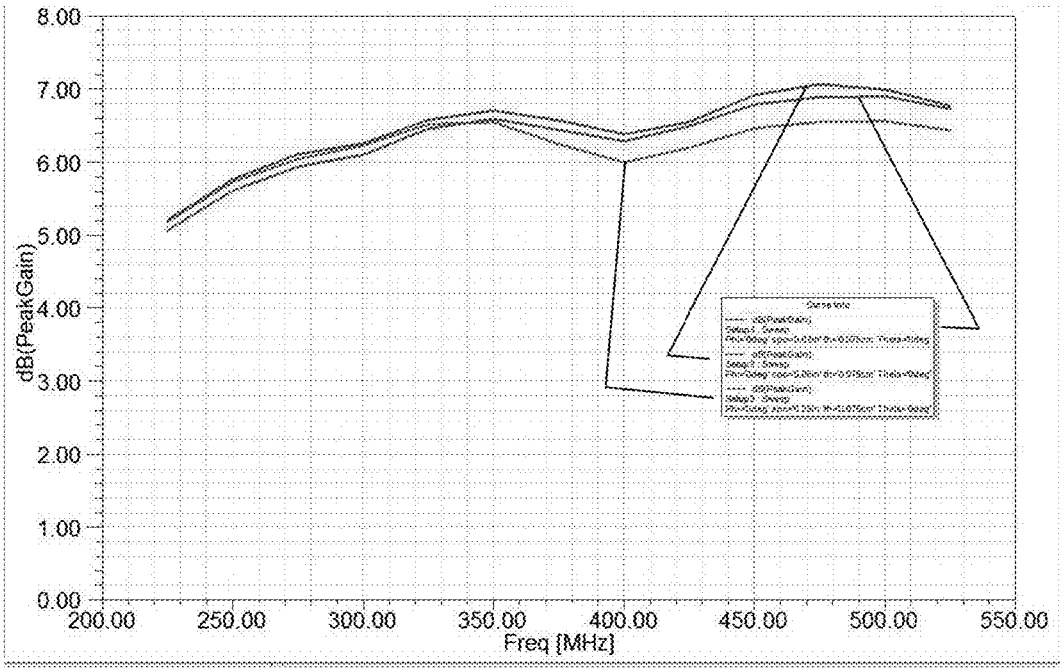
FIG. 20 is a graph of peak gain versus frequency for three transmission line gap configurations in an antenna tested in Example 3, in accordance with the present disclosure.

Further, in another non-limiting example, as shown in FIG. 20, the gap between the transmission lines connecting the solenoid bars may be used as an adjustable parameter for tuning final antenna designs for desired frequency bands. The optimum value for the gap between the transmission lines may be obtained in order to advantageously achieve a higher peak gain.

FIG. 20 is a graph of the peak gain of the dipole mode of three different transmission line gap configurations across a frequency band from about 200 MHz to 550 MHz. The red curve is an antenna with a 0.05" transmission line gap, the blue curve is an antenna with a 0.02" transmission line gap, and the green curve is an antenna with a 0.25" transmission line gap.

Example 4

In Example 4, a parallel solenoid feed was tested in a toroidal magnetic antenna. As can be seen from the results, a very good voltage standing wave ratio (VSWR) for mode 1 may be achieved by tuning the parallel solenoid cage as well as changing the number of grounded feed loops and the distance between twin lines, all with only a 4:1 transformer and without any complex matching circuit. Thus, the proposed parallel solenoid feed may be tuned specifically for any true magnetic antenna design.

Figure 21:
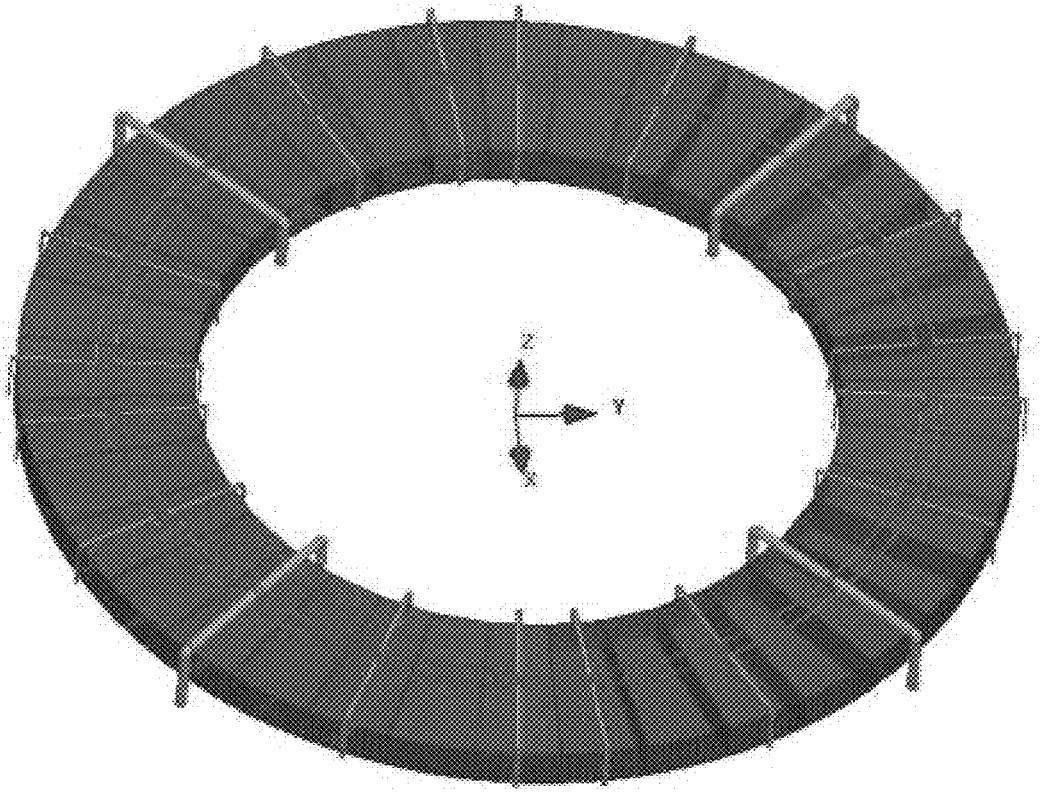
FIG. 21 is a schematic of a toroidal magnetic antenna with four feed loops and a parallel solenoid cage with 16 solenoid bars, in accordance with the present disclosure.

In antennas, such as toroidal or circular antennas, as shown in FIG. 21, using the parallel solenoid feed of the present disclosure results in higher peak and realized gain over previous feeds. Without being bound by theory, this enhanced performance of magnetic antennas with a parallel solenoid feed is due to the containment of the flux inside the material of the magnetic antenna.

In this example experiment, the effect of varying the number of solenoid bars as well as the distance between the twin lines of a toroidal magnetic antenna with a parallel solenoid feed is studied.

True magnetic antennas have high gain and a broad bandwidth. However, in order to have a good realized gain, an antenna needs to have a good VSWR. Many matching schemes can be used for this purpose. Some matching schemes involve many inductive and capacitive circuit elements, which add to the complexity of the antenna structure. The parallel solenoid may achieve good matching without any additional circuit elements and only a transformer, as is seen in the following example experiment using a toroidal magnetic antenna.

Figure 22A:
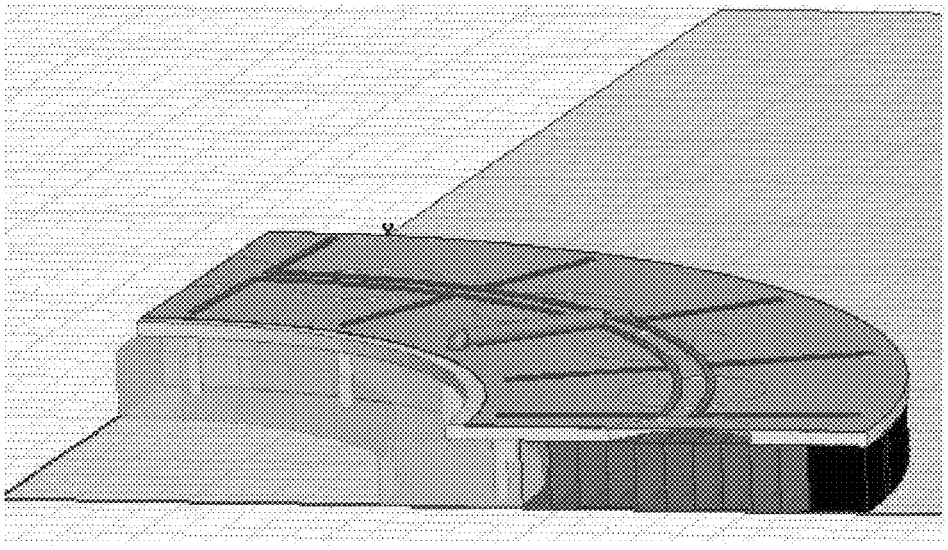
FIG. 22A is a side view of a quadrant of the toroidal magnetic antenna of FIG. 21, in accordance with the present disclosure.
Figure 22B:
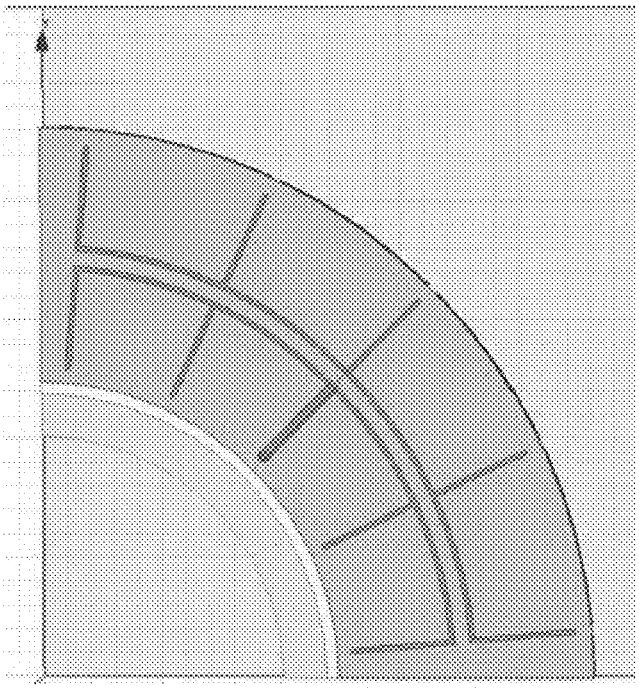
FIG. 22B is a top view of a quadrant of the toroidal magnetic antenna of FIG. 21, in accordance with the present disclosure.

FIGS. 21-22B show a toroidal magnetic antenna with four feed loops and a parallel solenoid cage with 16 solenoid bars that are grounded, similar to those seen in Examples 2-3.

Figure 23A:
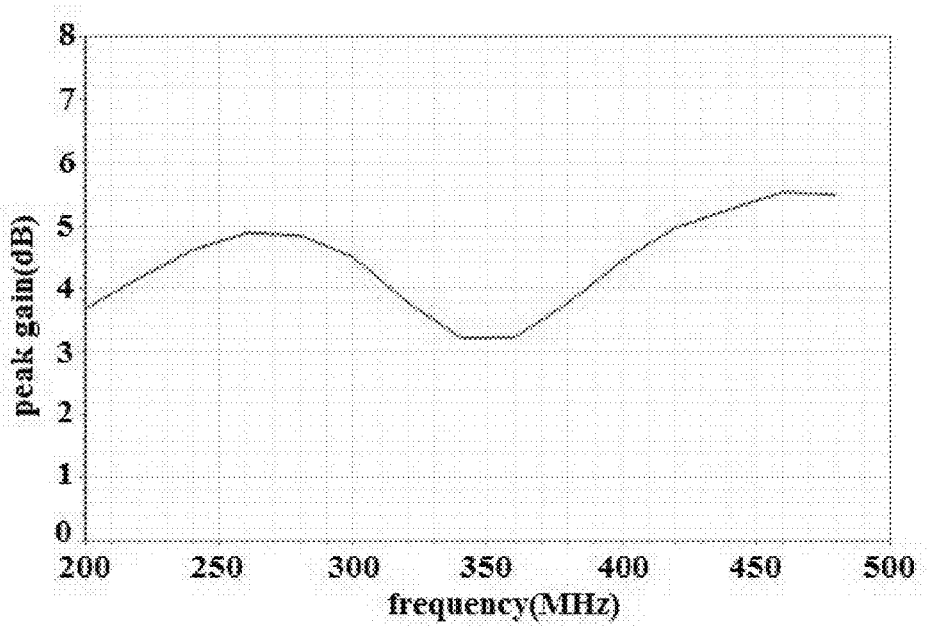
FIG. 23A is a graph of peak gain versus frequency of the toroidal magnetic antenna with 16 solenoid bars normalized to a 50Ω impedance tested in Example 4, in accordance with the present disclosure.
Figure 23B:
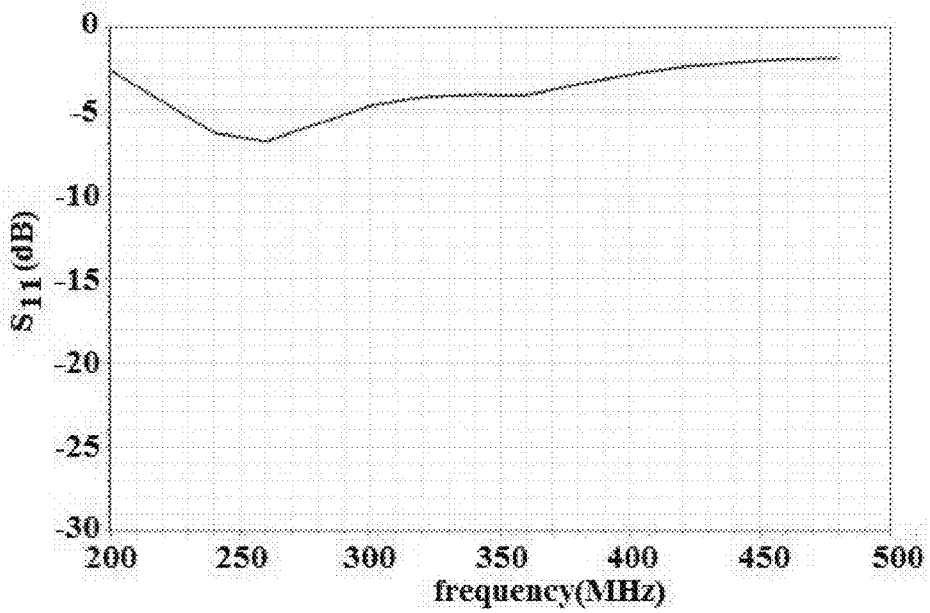
FIG. 23B is a graph of $S_{11}$ versus frequency of the toroidal magnetic antenna with 16 solenoid bars normalized to a 50Ω impedance tested in Example 4, in accordance with the present disclosure.

FIGS. 23A-B show the resulting peak gain and $S_{11}$ graphs of the toroidal magnetic antenna with 16 solenoid bars normalized to a 50Ω impedance across a frequency band of about 200 MHz to about 500 MHz. From FIGS. 23A-B, it can be seen that the VSWR should be improved.

Figure 24A:
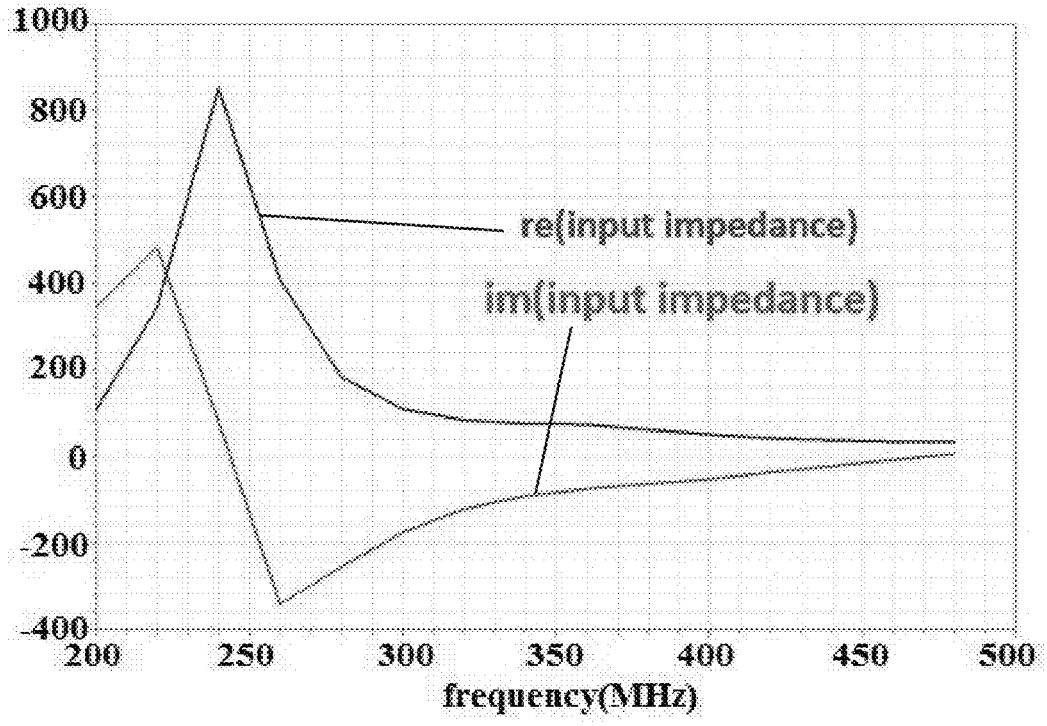
FIG. 24A is a graph of real and imaginary input impedance versus frequency of the toroidal magnetic antenna with 16 solenoid bars normalized to a 50Ω impedance tested in Example 4, in accordance with the present disclosure.
Figure 24B:
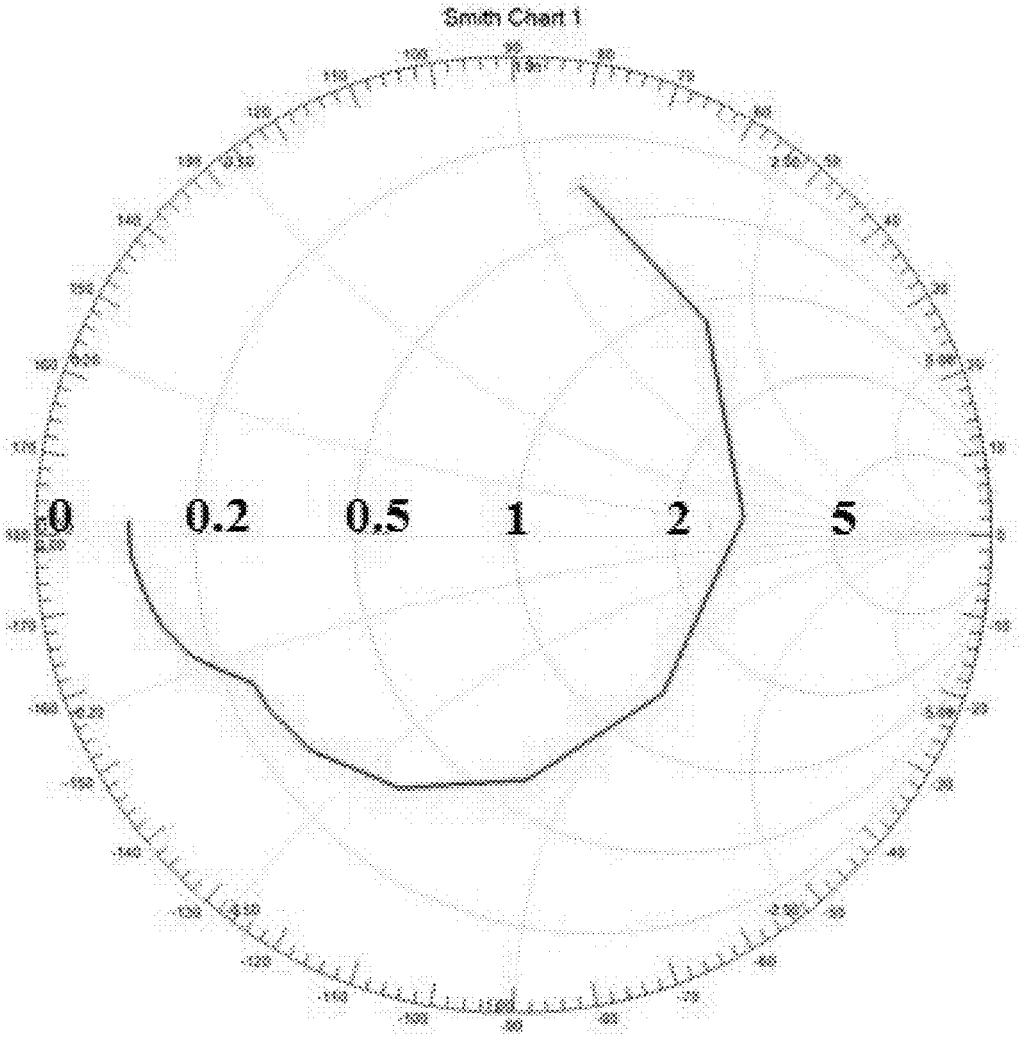
FIG. 24B is a Smith chart of the toroidal magnetic antenna with 16 solenoid bars normalized to a 50Ω impedance tested in Example 4, in accordance with the present disclosure.

To improve the VSWR, the matching approach is started by first looking at the impedance of the magnetic antenna through both the real and imaginary parts of the impedance as well as its Smith chart. FIGS. 24A-B show the resulting graphs of real and imaginary input impedance and a Smith chart of the toroidal magnetic antenna with 16 solenoid bars normalized to a 50Ω system impedance across a frequency band of about 200 MHz to about 500 MHz. The Smith chart in FIG. 24B for the antenna configuration with 16 solenoid bars indicated that a complex matching system would likely be needed and that a simple transformer would not make a significant difference.

Figure 25A:
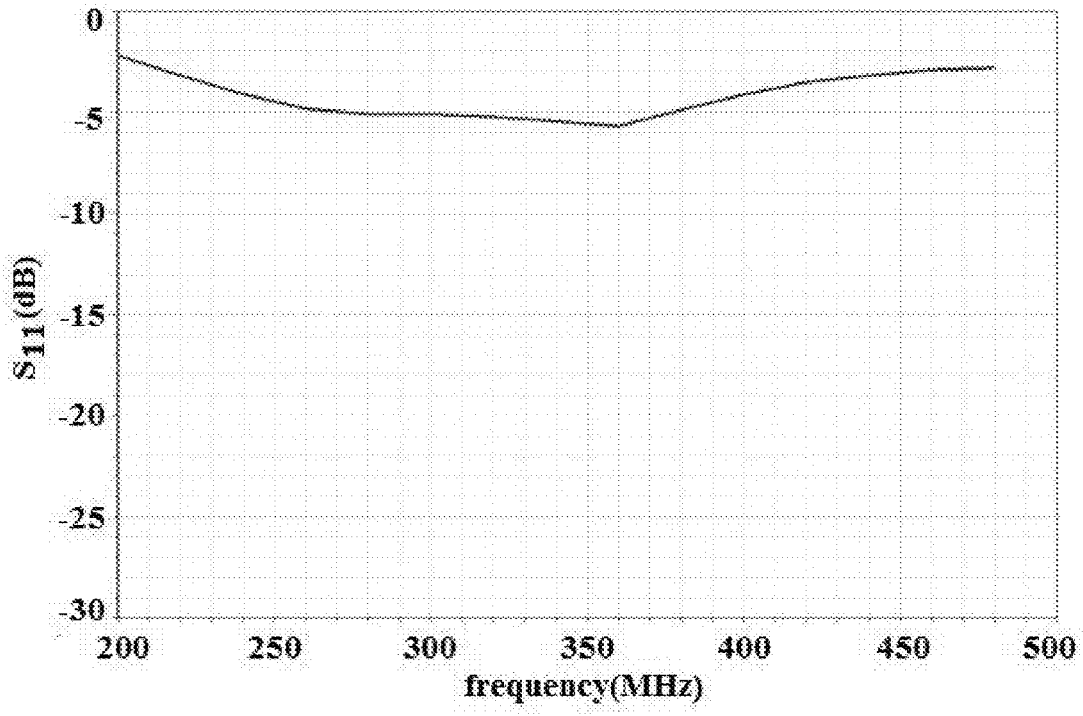
FIG. 25A is a graph of $S_{11}$ versus frequency of the toroidal magnetic antenna with 16 solenoid bars normalized to a 200Ω impedance tested in Example 4, in accordance with the present disclosure.
Figure 25B:
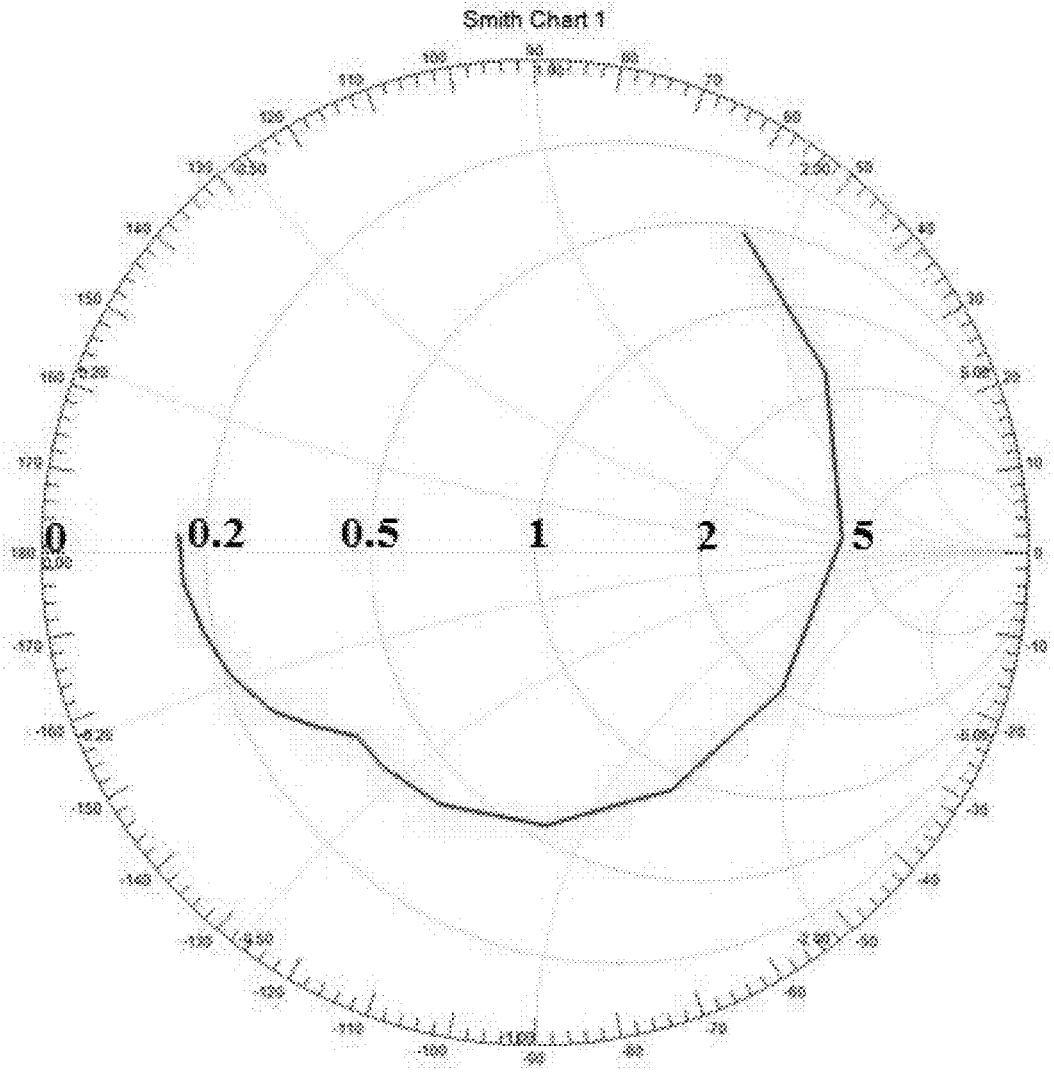
FIG. 25B is a Smith chart of the toroidal magnetic antenna with 16 solenoid bars normalized to a 200Ω impedance tested in Example 4, in accordance with the present disclosure.
Figure 25C:
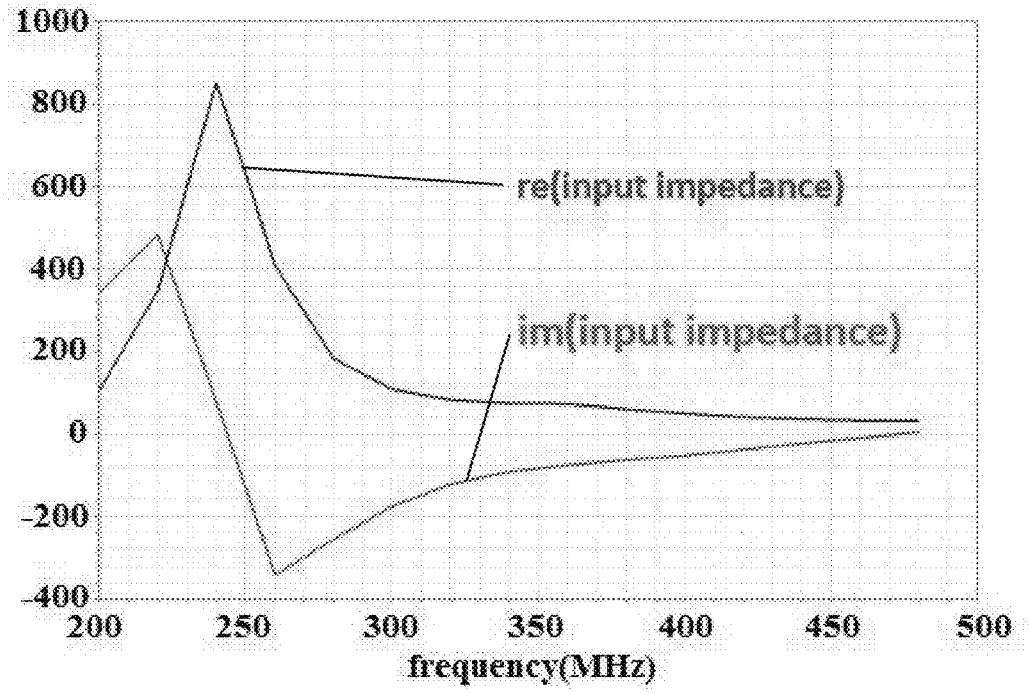
FIG. 25C is a graph of real and imaginary input impedance versus frequency of the toroidal magnetic antenna with 16 solenoid bars normalized to a 200Ω impedance tested in Example 4, in accordance with the present disclosure.

The reference system impedance was then changed from 50Ω to 200Ω. FIGS. 25A-C show the resulting graphs of $S_{11}$ and real and imaginary input impedance as well as the Smith chart for the toroidal magnetic antenna with 16 solenoid bars normalized to a 200Ω impedance across a frequency band of about 200 MHz to about 500 MHz. It can be seen from FIGS. 25A-C that changing the reference impedance from 50Ω to 200Ω did not improve the VSWR. Thus, a simple transformer cannot help with this antenna configuration.

Rather, tuning the parallel solenoid feed structure itself can aid in achieving a wide band match for the toroidal magnetic antenna without needing a complex matching system, which consists of many circuit elements that are usually not wide band. A second antenna configuration is tested with more solenoid bars and a larger gap between the curved twin line than the previously tested antenna configuration.

Figure 26A:
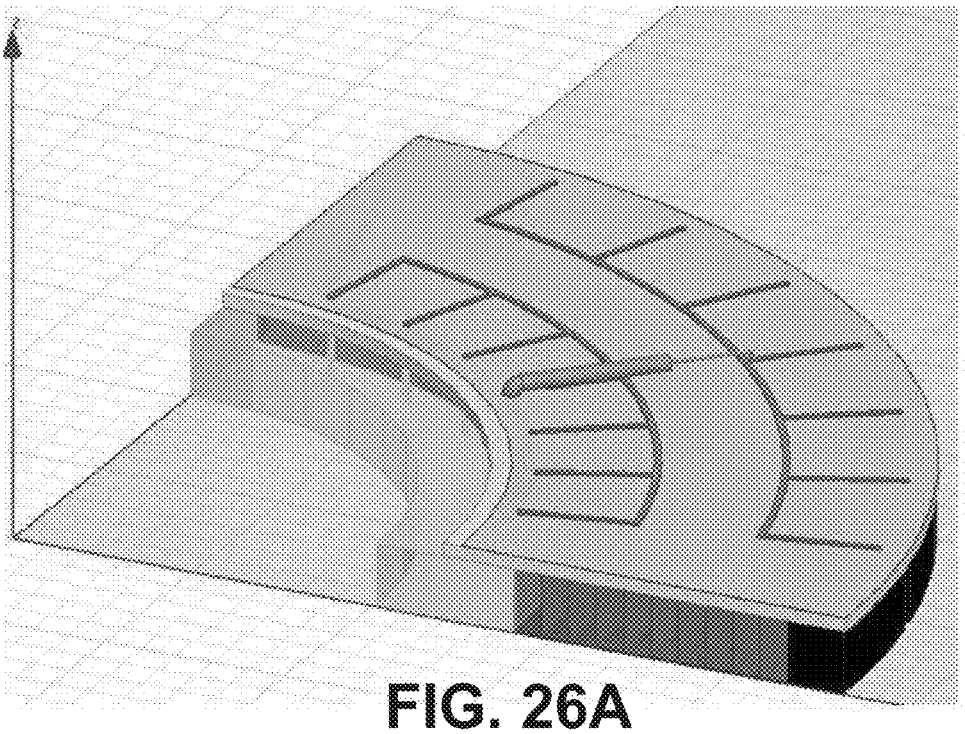
FIG. 26A is a side view of a quadrant of a toroidal magnetic antenna with four feed loops and a parallel solenoid cage with 24 solenoid bars, in accordance with the present disclosure.
Figure 26B:
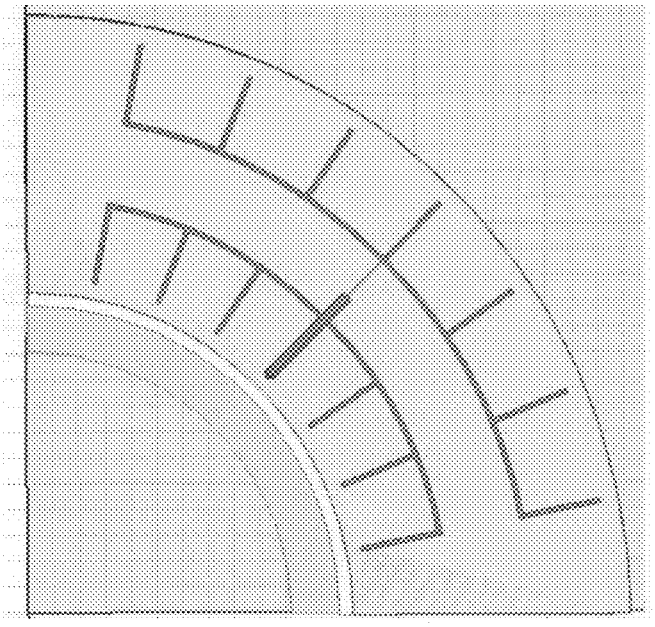
FIG. 26B is a top view of a quadrant of the toroidal magnetic antenna of FIG. 26A, in accordance with the present disclosure.

FIGS. 26A-B show a section of the second antenna configuration, which is a toroidal magnetic antenna with four feed loops and a parallel solenoid cage with 24 solenoid bars, which are connected to ground.

Figure 27A:
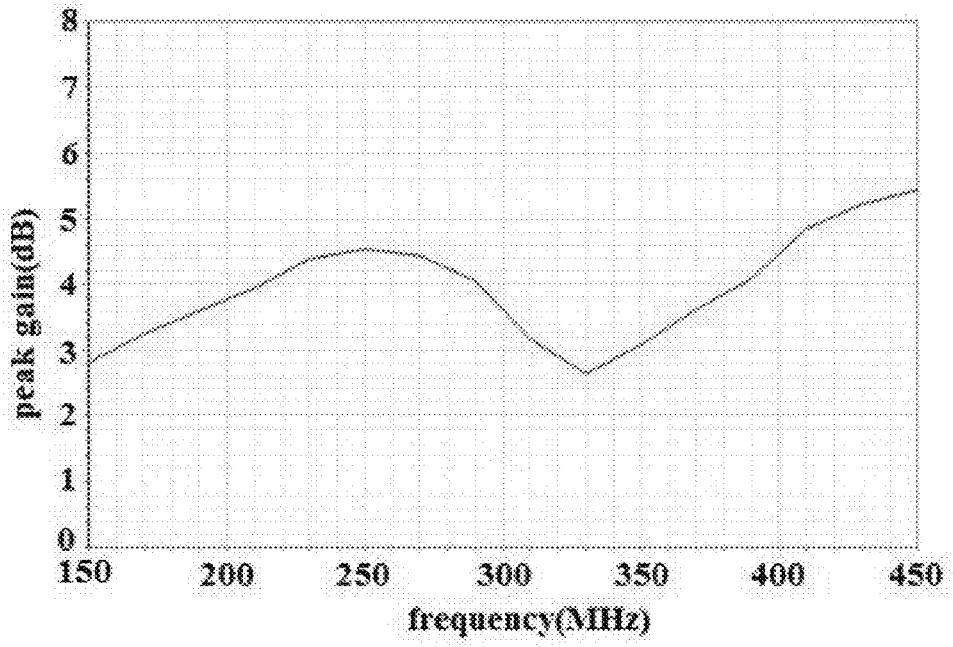
FIG. 27A is a graph of peak gain versus frequency of the toroidal magnetic antenna with 24 solenoid bars normalized to a 50Ω impedance tested in Example 4, in accordance with the present disclosure.
Figure 27B:
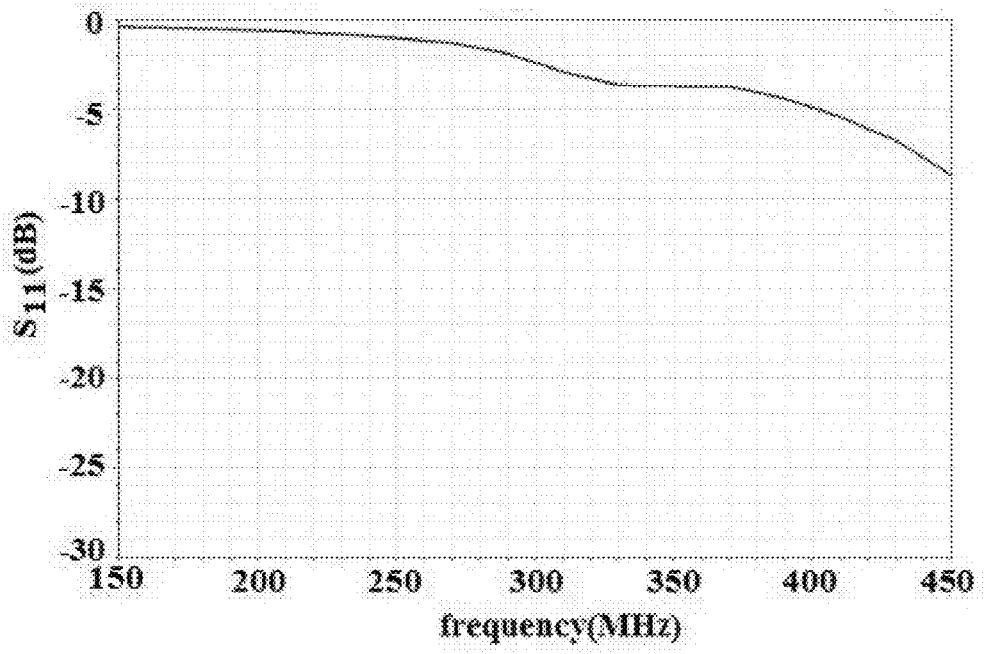
FIG. 27B is a graph of $S_{11}$ versus frequency of the toroidal magnetic antenna with 24 solenoid bars normalized to a 50Ω impedance tested in Example 4, in accordance with the present disclosure.

FIGS. 27A-B show the resulting graphs of peak gain and $S_{11}$ of the toroidal magnetic antenna with 24 solenoid bars normalized to a 50Ω impedance across a frequency band of about 150 MHz to about 450 MHz. The results in FIGS. 27A-B show that the VSWR did not indicate any improvement over the previously tested antenna configuration with 16 solenoid bars and a smaller gap between the curved twin line. However, as described below, the VSWR of this antenna configuration had considerable improvement when normalized to a 200Ω system impedance.

Figure 28A:
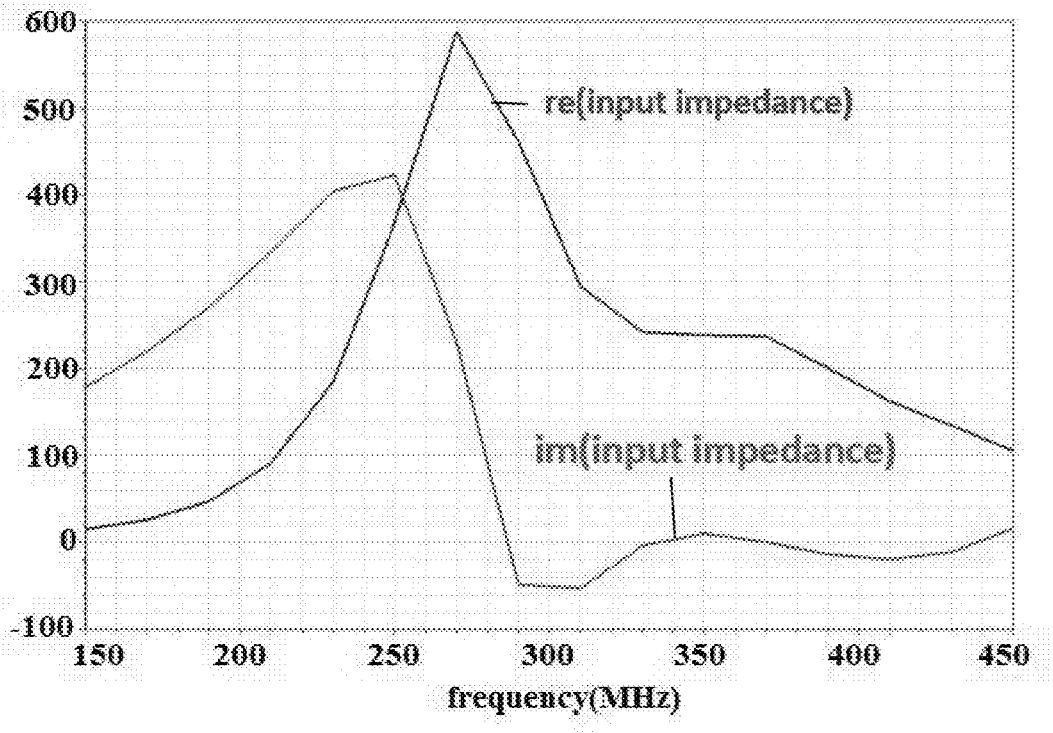
FIG. 28A is a graph of real and imaginary input impedance versus frequency of the toroidal magnetic antenna with 24 solenoid bars normalized to a 50Ω impedance tested in Example 4, in accordance with the present disclosure.
Figure 28B:
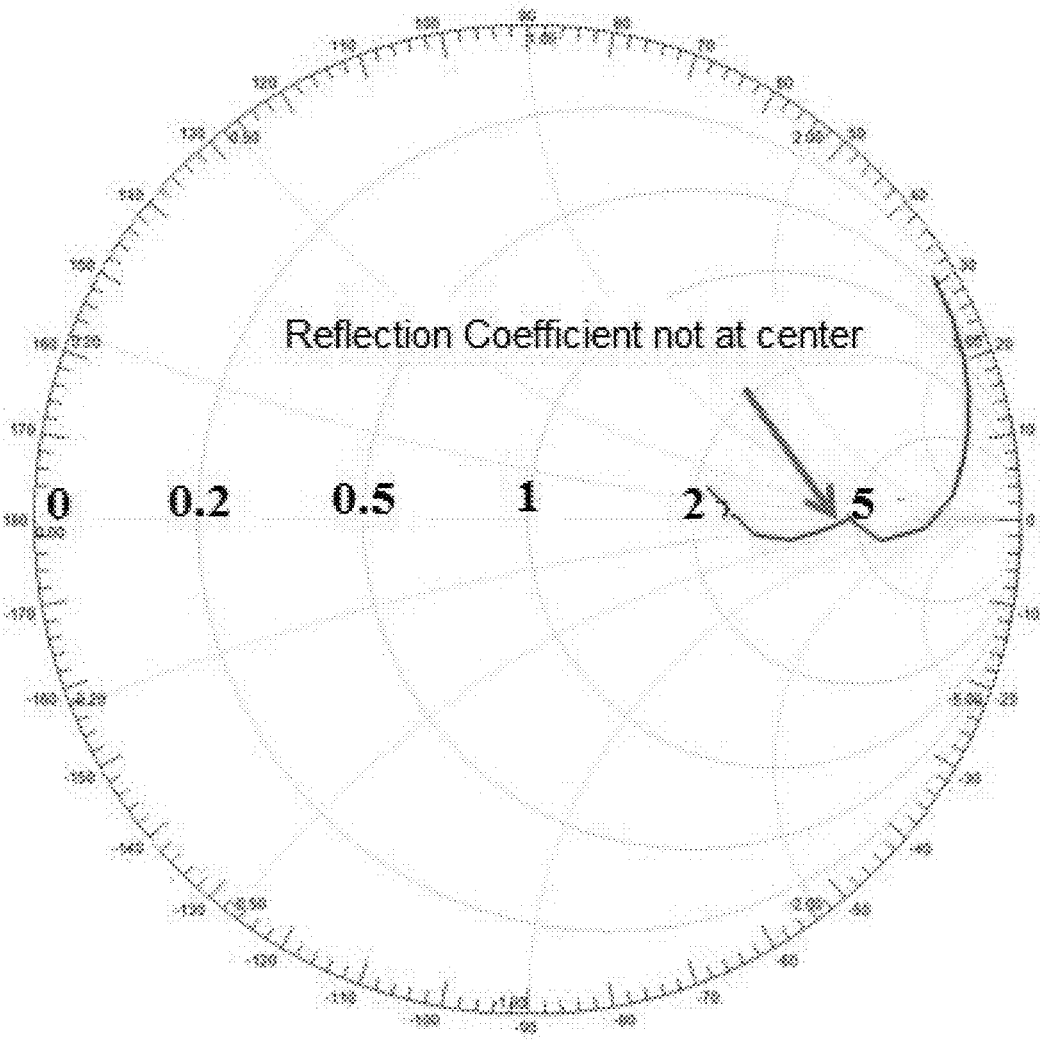
FIG. 28B is a Smith chart of the toroidal magnetic antenna with 24 solenoid bars normalized to a 50Ω impedance tested in Example 4, in accordance with the present disclosure.

In order to see the impedance behavior of the second antenna configuration, both the impedance and the Smith chart of the magnetic toroidal antenna were examined. FIGS. 28A-B show the resulting graph the real and imaginary input impedance and Smith chart for the toroidal magnetic antenna with 24 solenoid bars normalized to a 50Ω impedance across a frequency band of about 150 MHz to about 450 MHz. Although the reflection coefficient plotted in the Smith chart in FIG. 28B is not located at the center of the Smith chart, which is shown as an undesirable VSWR in FIG. 27B, it can be seen that the reflection coefficient is centered at the 5Ω location in the Smith chart. Thus, the Smith chart shown in FIG. 28B indicates that if a 200Ω system impedance is used (i.e., a 4:1 transformer is used), the reflection coefficient will be moved to the center of the Smith chart. A reflection coefficient located at the center of a Smith chart indicates that there is a good wide band match.

Figure 29A:
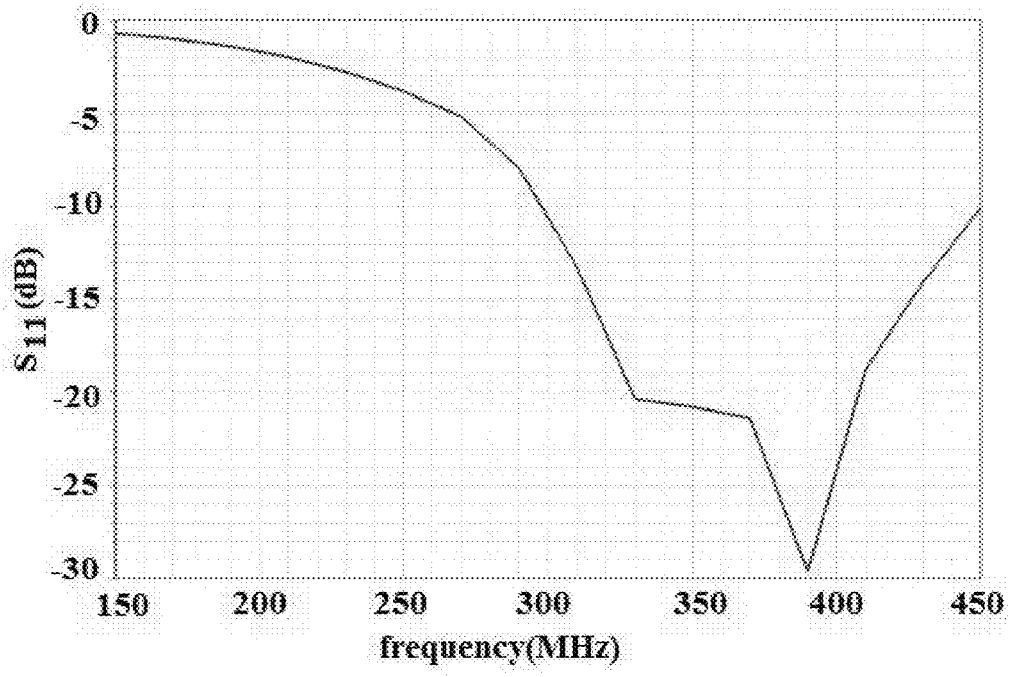
FIG. 29A is a graph of $S_{11}$ versus frequency of the toroidal magnetic antenna with 24 solenoid bars normalized to a 200Ω impedance tested in Example 4, in accordance with the present disclosure.
Figure 29B:
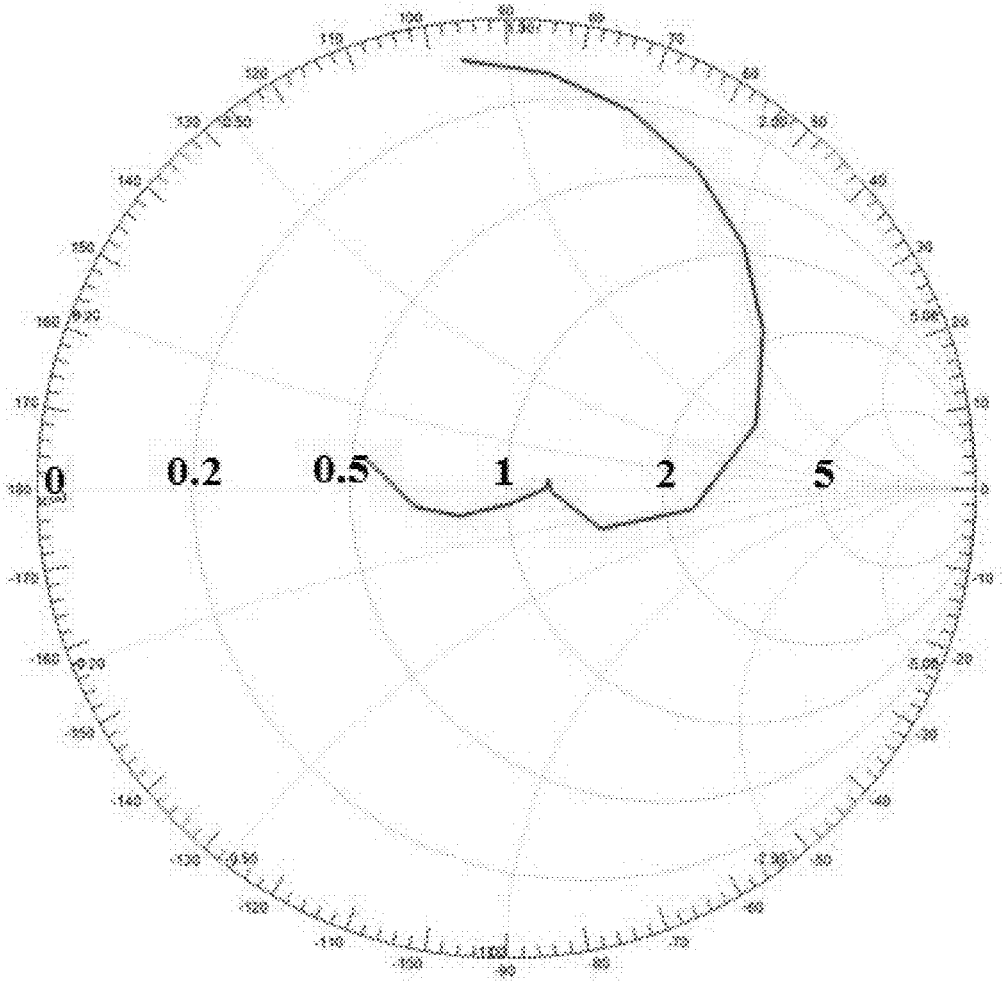
FIG. 29B is a Smith chart of the toroidal magnetic antenna with 24 solenoid bars normalized to a 200Ω impedance tested in Example 4, in accordance with the present disclosure.

The 24 solenoid bar antenna configuration was then tested at a system reference impedance normalized to 200Ω, rather than 50Ω, using the 4:1 transformer. FIGS. 29A-B show the resulting graph of $S_{11}$ as well as the Smith chart for the toroidal magnetic antenna with 24 solenoid bars normalized to a 200Ω impedance across a frequency band of about 150 MHz to about 450 MHz. The results in FIGS. 29A-B show a good VSWR for the second antenna configuration that was achieved using only a 4:1 transformer. Thus, the parallel solenoid feed may be tuned by adjusting the number of bars and the gap between the curved twin line to achieve a good VSWR for a magnetic antenna without using complex matching circuits.

Example 5

This Example demonstrates the effect of the parallel solenoid feed on a magnetic Archimedean spiral antenna.

I. Overview

In this Example, we demonstrate another useful feature of the parallel solenoid feed which is a new kind of electric feed configuration for permeable antennas for the specific example of an Archimedean spiral. In previous examples, we had shown that for the toroidal magnetic antenna in addition to the solenoid overcoming the problems of conventional solenoid feeds and the better performing multiple parallel loop feed systems, it could be used as a tuning aid to obtain desirable properties for any specific design. Previously we had shown that the for magnetic antennas such as toroidal magnetic antennas and rods, using the solenoid feed will enhance the performance of the antenna by maintaining the flux which results in higher peak gain and higher realized gain and it gives us the ability to be use it as a tuning mechanism to achieve specific design goals. The magnetic antenna presented in this Example is a spiral antenna. In this Example, we have demonstrated the design and simulation of a magnetic spiral antenna built with 123 NiZn tiles each with a 4 inch×4 inch cross section and 6 mm thickness. Similar to the previously design toroidal magnetic antenna, this magnetic antenna also needs a proper flux channel to prevent the flux from escaping the magnetic material. One goal is to design a spiral antenna with high gain, frequency independent impedance behavior, and a circular polarization, and we show how the parallel solenoid feed is necessary to obtain the desirable antenna properties.

In the next sections of this Example, we start with the theory of spiral antennas and how it would affect the design of the magnetic antenna in terms of the spiral active region. The basic Archimedean spiral with one feed at the center using the ferrite tiles will be demonstrated. We show how using a solenoid feed would help with both increasing the gain and achieving a frequency independent behavior. We also compare three different magnetic spiral antenna geometries which are the magnetic spiral antenna without any solenoid feed, the same antenna with an 8 loop solenoid touching the ferrite, and the final design which is the solenoid fed antenna with 30 loops to ground. The comparison shows the benefit of the solenoid feed and the importance of having a small gap between the solenoid and the ferrite surface. We show how crucial the parallel solenoid feed is.

The final antenna geometry and results have been shown and the patterns show the circular polarization. We have also shown that the antenna has a good efficiency in the frequency limit of operation defined by the smallest and largest active region. We describe the results of using the CZN (Cobalt Zirconium Niobium alloy) Ferromagnetic metal laminates to build the antenna instead of the NiZn tiles. We see a significant increase in gain and efficiency which is the result of much higher resistivity of the laminates.

II. Basic Archimedean Spiral with One Feed at the Center

Figure 30:
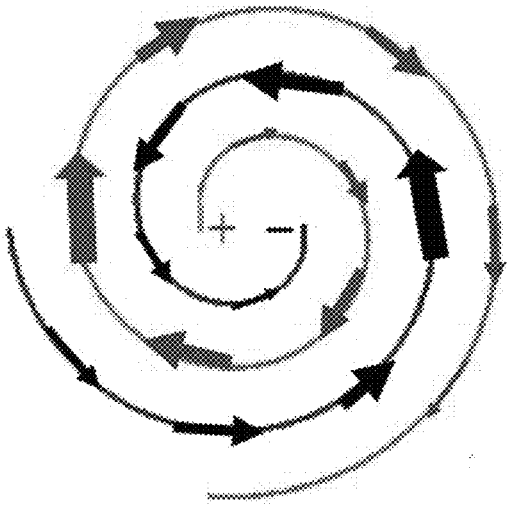
FIG. 30 shows currents on a spiral antenna at a very large bandwidth.

In order to get an idea of how the parallel solenoid works for the case of the spiral antenna and why it is necessary; we have to first understand how the spiral antenna works. A spiral antenna is a frequency independent antenna by nature. FIG. 30 shows the current on a two wire spiral antenna. If the wavelength is very large as is the case shown in FIG. 30, we can see the current amplitude in the first half wavelength which is a sine function. If we make the wave length too long it will look like we have a bent two wire transmission line that where ever we have a current, right next to it we have a an opposing current and an observer at the far field would not expect radiation to occur.

Figure 31:
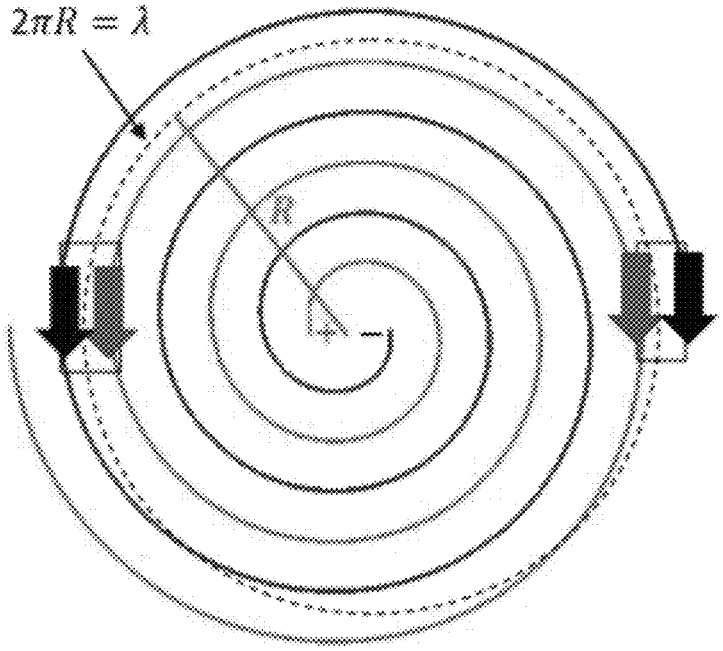
FIG. 31 shows a demonstration of a spiral active region and the currents.

However, if we go far enough we will reach a point over which the wave on the wire undergoes a 180 degree phase shift as the wire physically sweeps zero degrees to π. We will get to a point on the spiral that the currents on adjacent arms on the spiral are pointing in the same direction and the currents on the other side are also pointing in the same direction. A far field observer will not see any radiation coming from the origin but as he moves further he will see a region (a band) that seems to be the source of all the radiation. The circle seen in FIG. 31 is called the active region and in that region we seem to have all the radiation sources for the specific frequency in which $2\pi R=\lambda$. The reason that this structure is frequency independent is that at all frequencies; if the spiral is big enough, we will have an active region for that frequency. The region appears for high frequencies near the origin and for the lower frequencies far from the origin.

Figure 32:
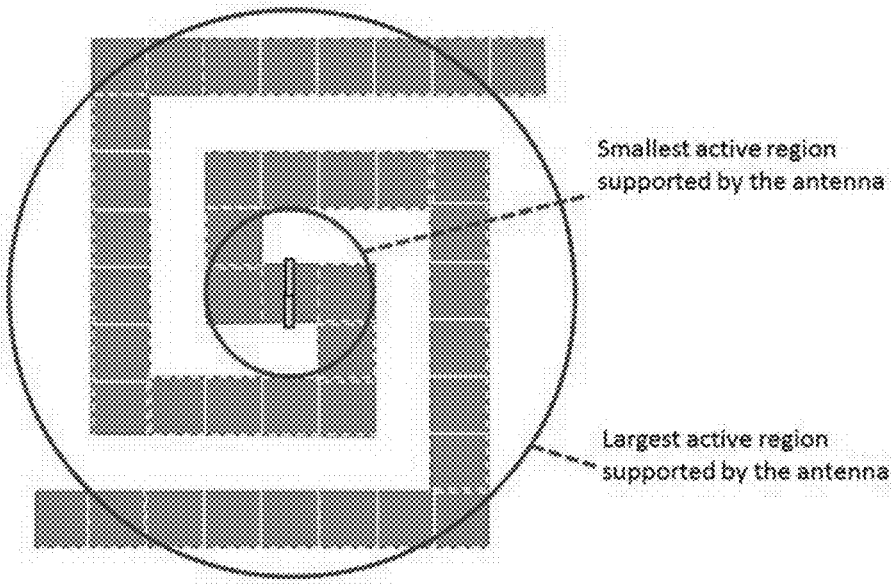
FIG. 32 shows smallest and largest active region supported by the antenna.

If in addition to the scaling property the structure is also self-complementary then absolute frequency independence of the impedance is guaranteed. Since we are limiting the dimension of the antenna, we will have a minimum frequency that the antenna could work in defined by the outer radius of the spiral and a maximum defined by the smallest turn near the center. FIG. 32 shows the smallest and largest active region for a spiral antenna. Below we will see how this would show up in the gain and efficiency results.

Figure 33:
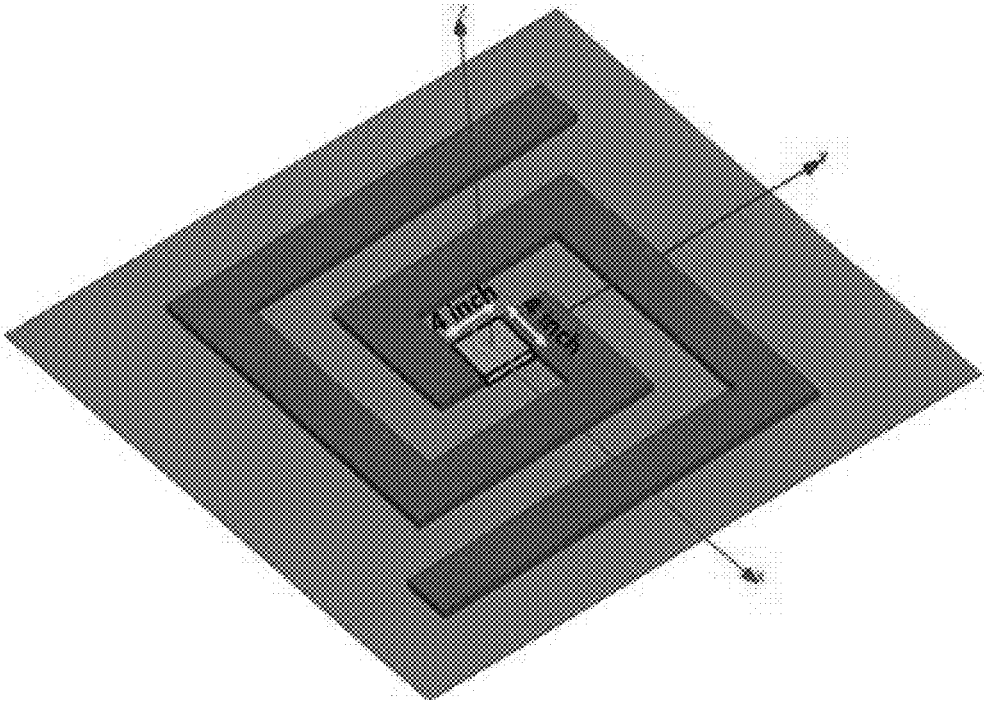
FIG. 33 shows a basic model of a ferrite Archimedean spiral antenna with only one feed at the center.

An Archimedean spiral has been designed using 123 NiZn tiles each with a 4 inch×4 inch cross section and 6 mm. thickness and the unit tile highlighted in FIG. 33 includes three tiles stacked on top of each other resulting in 18 millimeters total height of the spiral. The spiral shown in FIG. 33 has been fed with one feed loop at the center of the antenna. At this point we expect the flux to leak since we only have one feed at the center. As we have guessed at this point and the results will prove later, the parallel solenoid feed is necessary to keep the flux inside the magnetic spiral.

Figure 34A:
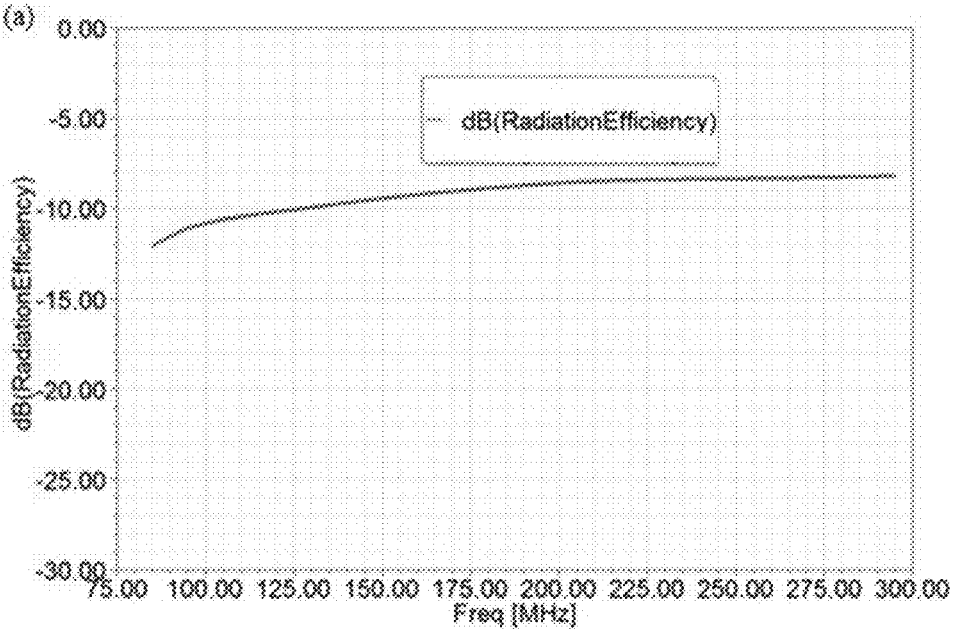
FIG. 34A shows efficiency of the single fed spiral antenna.
Figure 34B:
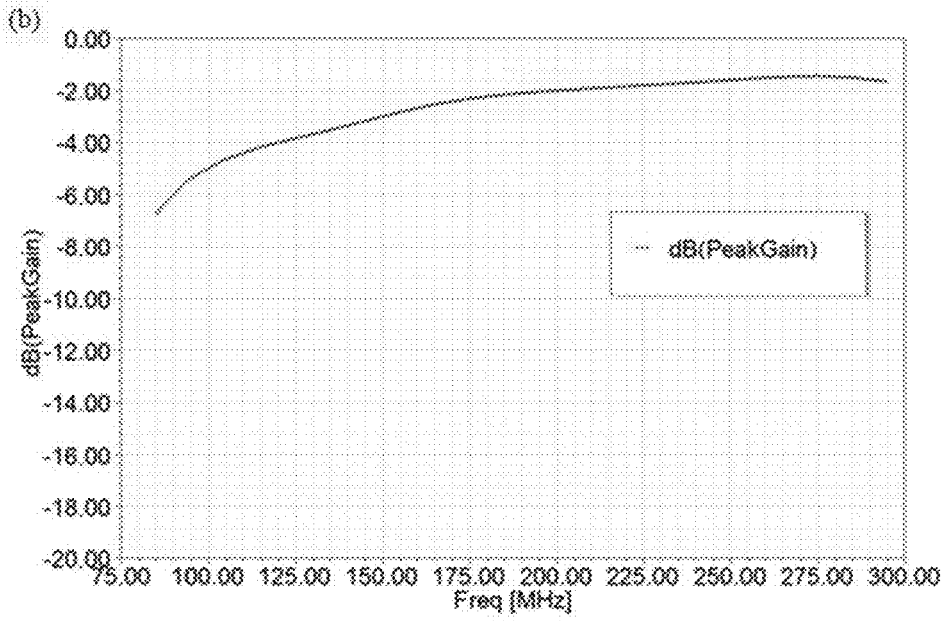
FIG. 34B shows peak gain of the single fed spiral antenna, and the impedance of the basic ferrite Archimedean spiral antenna have been shown in FIG. 33.
Figure 35:
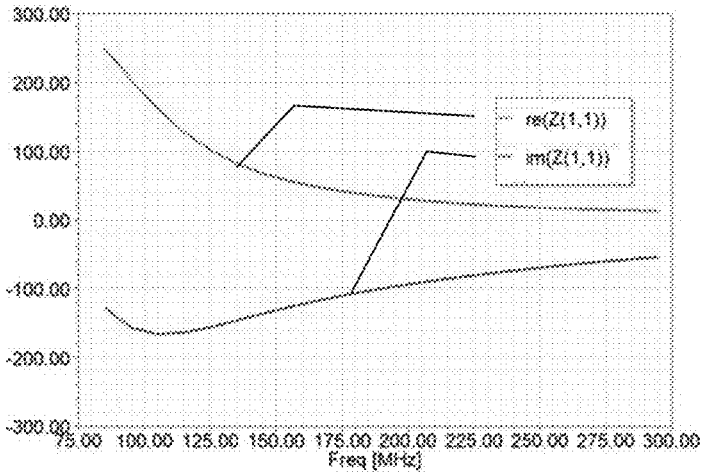
FIG. 35 shows impedance of the single fed spiral antenna.

The efficiency, gain, and the impedance of the basic ferrite Archimedean spiral antenna have been shown in FIG. 34A, FIG. 34B, and FIG. 35.

FIG. 35 shows that the impedance response is not frequency independent which we already expected since there is no way to keep the flux from leaking from the structure.

A plot of the $\oint E \cdot dl$ along the structure which is the magnetic current $I_m$ can clearly show if this is the case.

Figure 36:
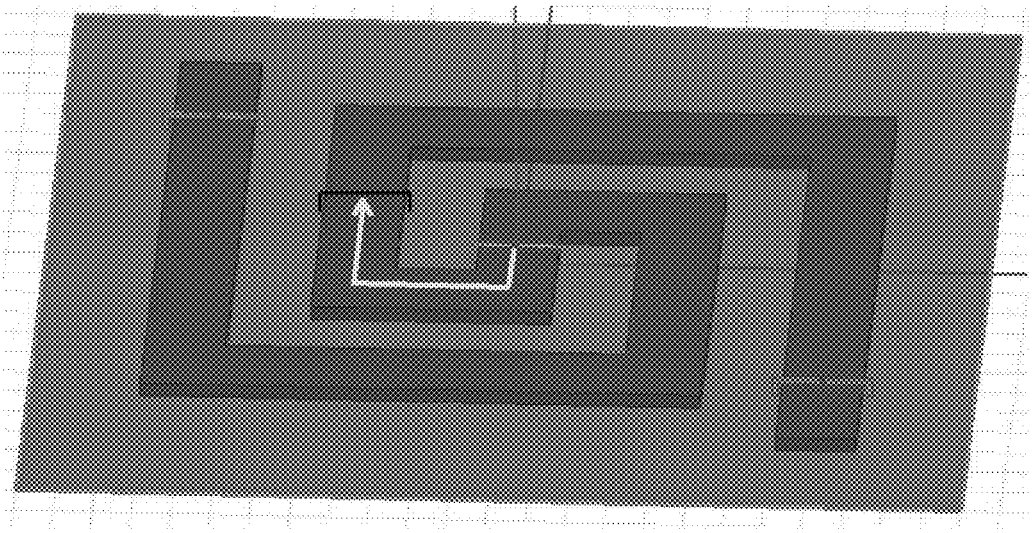
FIG. 36 shows the definition of the integration path.

In order to do this we will use HFSS field calculator as follows. We define integration paths as shown by the black loop in FIG. 36. The distance from feed is defined as the length of the path from feed to the integration path as shown by the yellow arrow. After calculating the integral along a number of integration paths we can plot $\oint E \cdot dl$ as a function of distance from the feed point.

Figure 37:
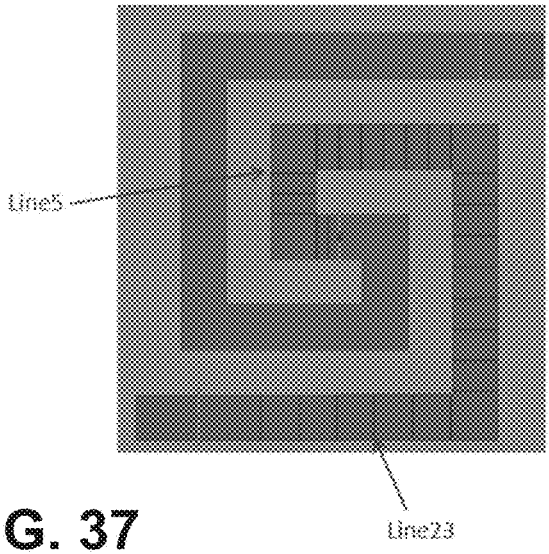
FIG. 37 a few integration paths and a table of the distance of the paths from the center for the single loop fed spiral antenna.

A few integration paths and a table of the distance of the paths from the center can be seen in FIG. 37 and the numbering of the lines is as shown in the HFSS model below.

Figure 38:
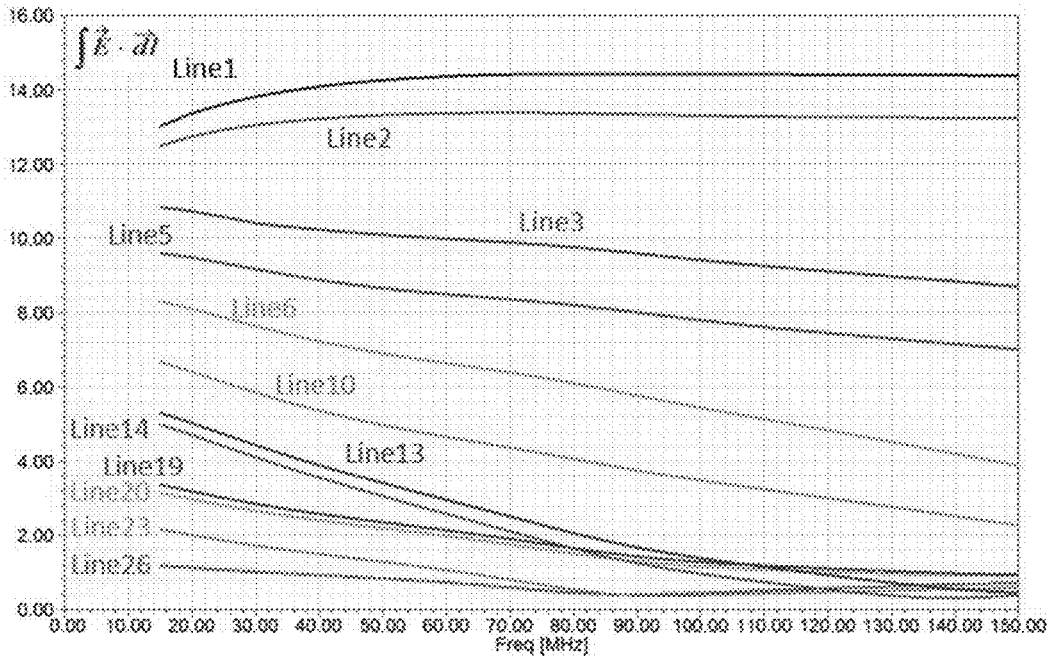
FIG. 38 shows integral versus frequency for different lines for the single loop fed spiral antenna.

By having the integration data we can plot the integral versus frequency for different lines as seen in FIG. 38. We can see that the as we get further from the feed, the flux escapes therefore similar to other magnetic antennas, using the parallel solenoid is necessary.

Figure 39:
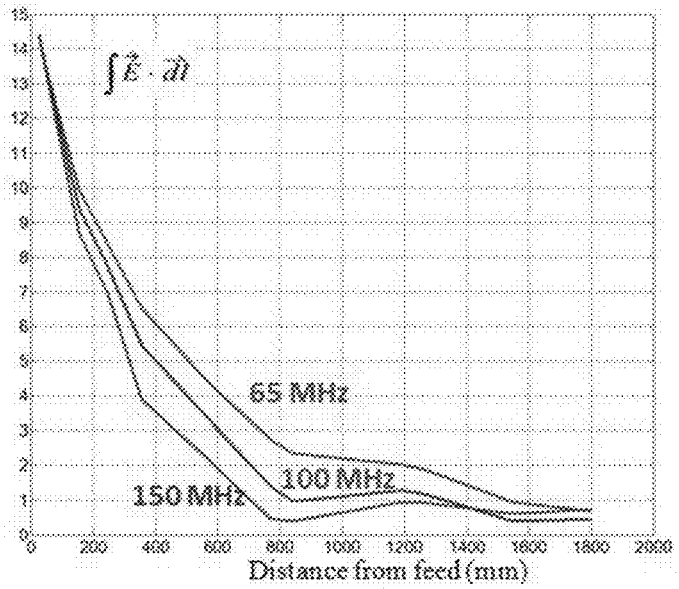
FIG. 39 shows a value of $\oint E \cdot dl$ versus distance from the feed.

We have also plotted $\oint E \cdot dl$ versus distance from the feed at three different frequencies as seen in FIG. 39.

Figure 40:
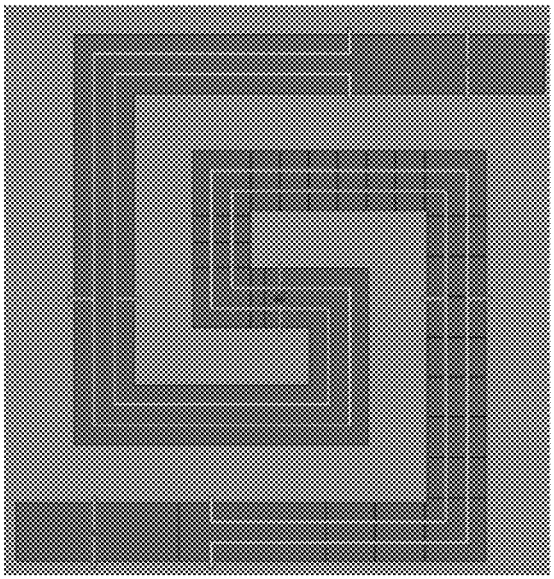
FIG. 40 shows a few integration paths and a table of the distance of the paths from the center for the 4 loop solenoid fed spiral antenna.

FIG. 38 also shows that there is no mechanism to keep the flux inside the material. Therefore the next step would be adding a solenoid feed with loops to ground as seen below. First we start with a solenoid feed with only 4 loops to ground. The lines shown in black are integration paths and numbering of the lines is similar to what we had before and in this structure there is a 3 mm. distance between the solenoid and the ferrite. The integration lines (paths) have a 1 mm. distance from the ferrite which makes them identical to the paths for the previous case (without the solenoid). A few integration paths and a table of the integration values can be seen In FIG. 40.

Figure 41:
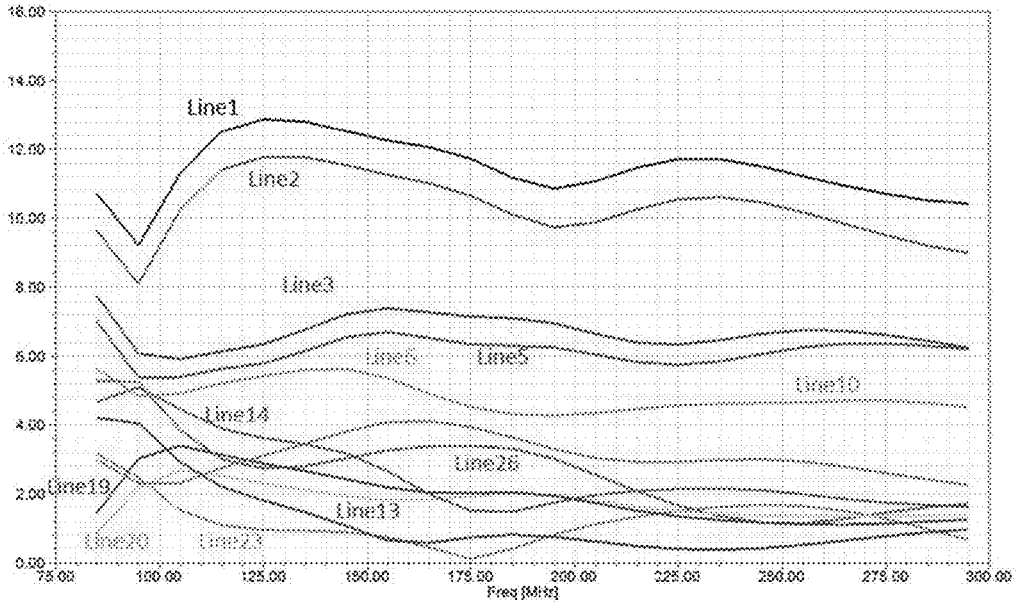
FIG. 41 shows an integral versus frequency for different lines for the 4 loop solenoid fed spiral antenna.

The integral versus frequency for different lines is shown in FIG. 41. It can be seen that a line that is farther from the feed, does not necessarily have lower flux at all frequencies which is the effect of adding the solenoid.

Figure 42A:
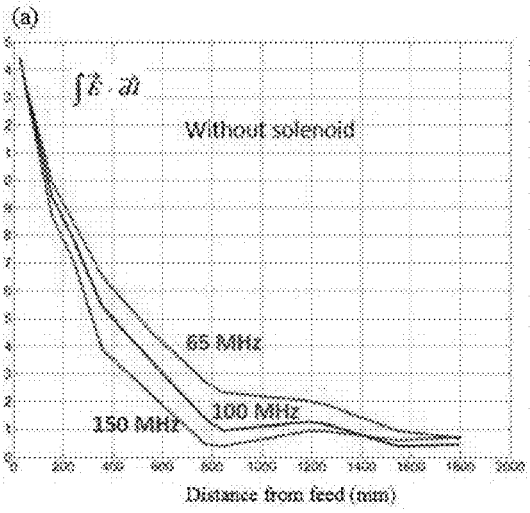
FIG. 42A shows a plot of $I_m = \int E \cdot dl$ for a spiral antenna with one feed loop at the center.
Figure 42B:
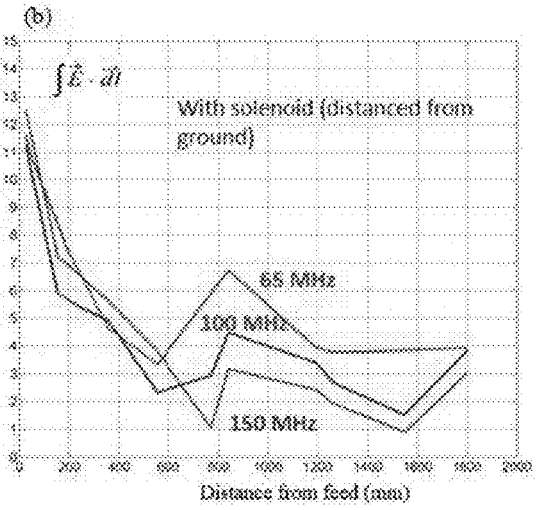
FIG. 42B shows a plot of $I_m = \int E \cdot dl$ for the solenoid fed spiral antenna with 4 loops to ground, showing an increase in Im at the position of the loop.

This means that there is a mechanism that is trying to keep the flux inside the material. A plot of the $\oint E \cdot dl$ versus distance from the feed at a few frequencies similar to what had been done in FIG. 42 will help to see this more clearly. In order to compare these two cases we have shown the flux versus distance of the two cases side by side. It can be seen that at the position of the loop to ground we have an increase in the flux. Therefore below we study the effect of adding more grounded loops to the solenoid.

III. The Effect of Using a Solenoid Feed with Multiple Grounded Loops

Figure 43:
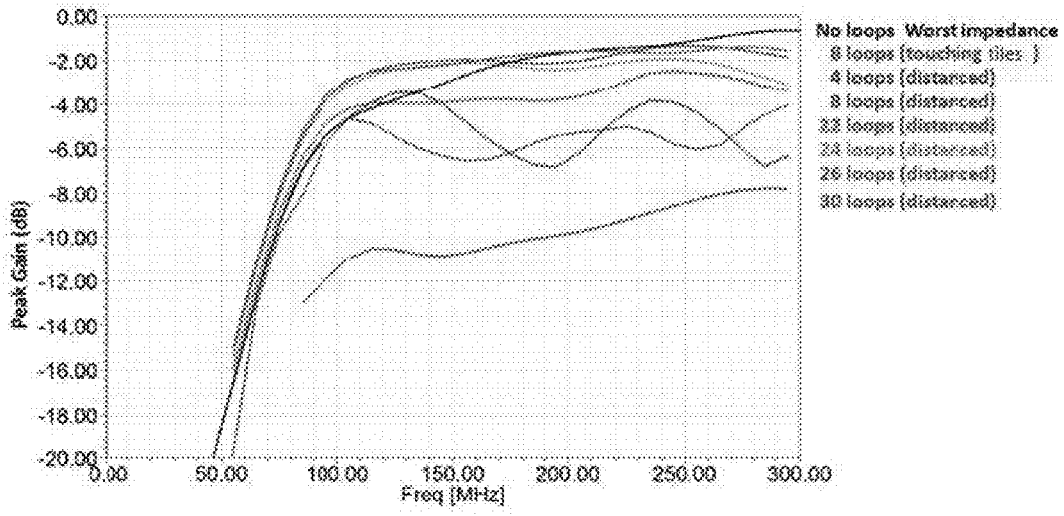
FIG. 43 shows changes in peak gain when we change the number of loops to ground from 4 loops to 30 loops and comparing the results to the case without the solenoid and the case of the 8 loop structure touching the ferrite.

In the previous section we saw that adding four grounded loops and using a solenoid feed will help maintain the flux. Therefore we study the effect of adding even more loops to ground. Our goal is to achieve a high gain while having impedance that is frequency independent since the impedance shown in FIG. 35 is not. We also show that the solenoid should have a distance from the ferrite surface and then we show that adding the number of loops will result in smoother impedance and a higher gain and efficiency. FIG. 43 shows how the peak gain changes with adding more and more loops. It should be noted that as the bottom plot shows, when the solenoid feed is touching the ferrite we have a significant loss. Therefore in all other cases, which are named as distanced, we have a 3 mm. gap between the solenoid feed and the ferrite.

Figure 44:
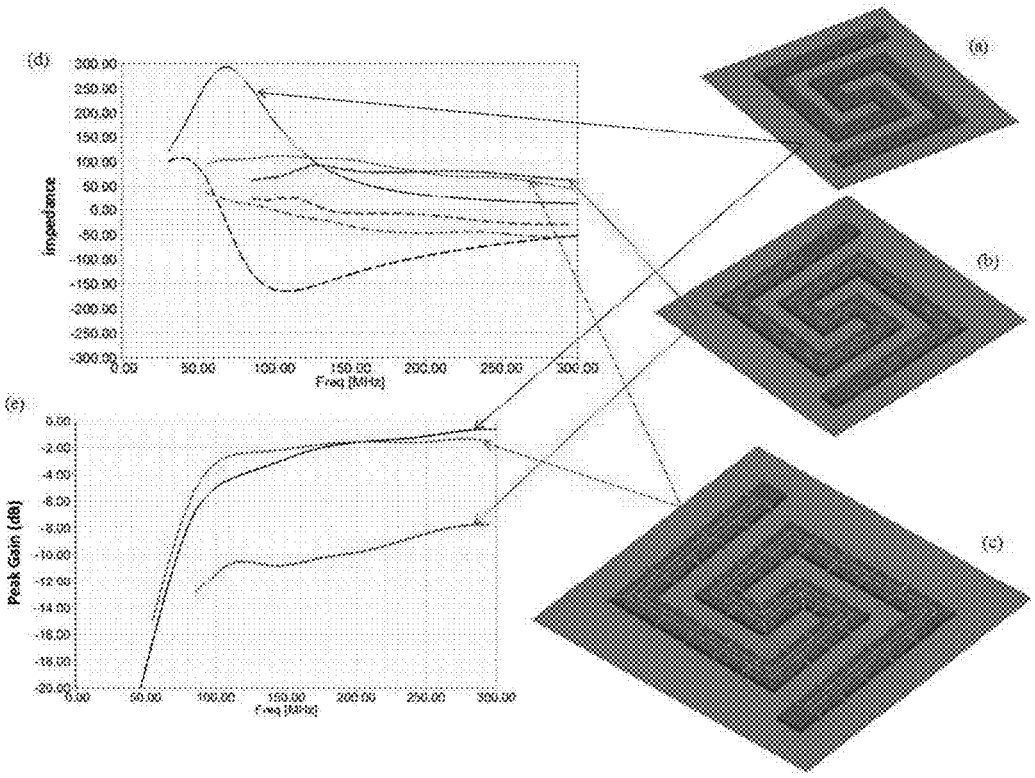
FIG. 44 shows: at label (a) magnetic spiral antenna without any solenoid feed; at label (b) magnetic spiral antenna with an 8 loop solenoid touching the ferrite and; at label (c) the solenoid fed spiral antenna with 30 loops to ground; at label (d) the impedance of each of the antennas; and at label (e) the gain of the antennas.

The comparisons between the gains show that adding the loops will increase the gain but another important factor is the impedance behavior. FIGS. 44(*a*), (*b*), and (*c*), show three different cases. The first case is the magnetic spiral antenna without any solenoid feed, the second case is the antenna with an 8 loop solenoid touching the ferrite and the third case is the solenoid fed antenna with 30 loops to ground. The impedance of each of these antennas has been plotted in FIG. 44(*d*) and the gain is plotted in FIG. 44(*e*). We see that the antenna with the 30 loop solenoid has both high gain and frequency independent impedance.

At this point a comparison between the reflected power, the radiated power, and the lost power of the three mentioned antennas would be useful. These powers are defined as seen in equations below and can be calculated from the data obtained from HFSS.

$$P_{radiated} = \text{efficiency} \times (1 - |\Gamma|^2)$$

$$P_{reflected} = |\Gamma|^2$$

$$P_{lost} = P_{accepted} - P_{radiated}$$

$$P_{lost} = (1 - |\Gamma|^2) - \text{efficiency} \times (1 - |\Gamma|^2)$$

Table A below shows the values of these powers for each antenna.

TABLE A

| | Results at 250 MHz | | |
|---|---|---|---|
| | $P_{reflected}$ | $P_{radiated}$ | $P_{lost}$ |
| Antenna with no solenoid | 62% | 6% | 32% |
| 8 loop antenna | 8% | 2% | 90% |
| 30 loop antenna | 15% | 16% | 69% |

We can see that the final antenna (Antenna with 30 loops to ground) has the most power radiated which again shows the importance of the solenoid feed. The reason that the power lost in the case with no solenoid seems to be low is that most of the power is already reflected which means frequency dependent behavior and bad VSWR. The low reflected power of the final antenna shows a good match. If we want to have an estimate of how much power the antenna stores, we can remember that similar to the case of resonators an antenna that stores more energy must have a higher Q. Since we have the impedance data of these antennas we can calculate the derivative of the impedance and use Steve Best's equation to obtain the Q. Although the stored energy is not measurable or accessible, a comparison of the Q's will shows us how much energy the antennas are storing compared to each other.

$$Q(\omega_0) \approx \frac{2\sqrt{\beta}}{FBW(\omega_0)} \approx \frac{\omega_0}{2R_0(\omega_0)} |Z_0'(\omega_0)|$$

Figure 45:
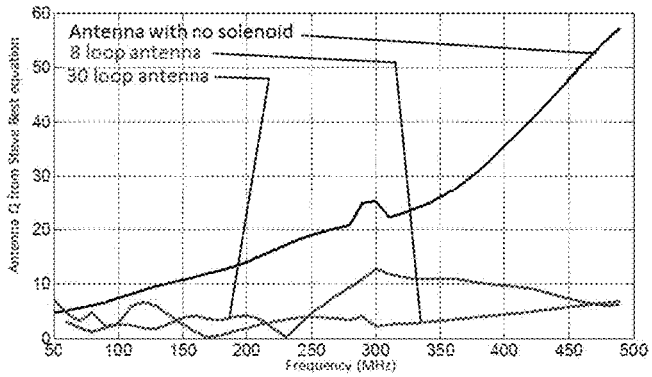
FIG. 45 shows a value of Q versus frequency for three spiral antennas.

Using the equation above we have plotted the antenna Q from Best's equation and we can see that the antenna with no solenoid has the highest Q. See FIG. 45.

IV. Antenna Geometry and Results

Figure 46:
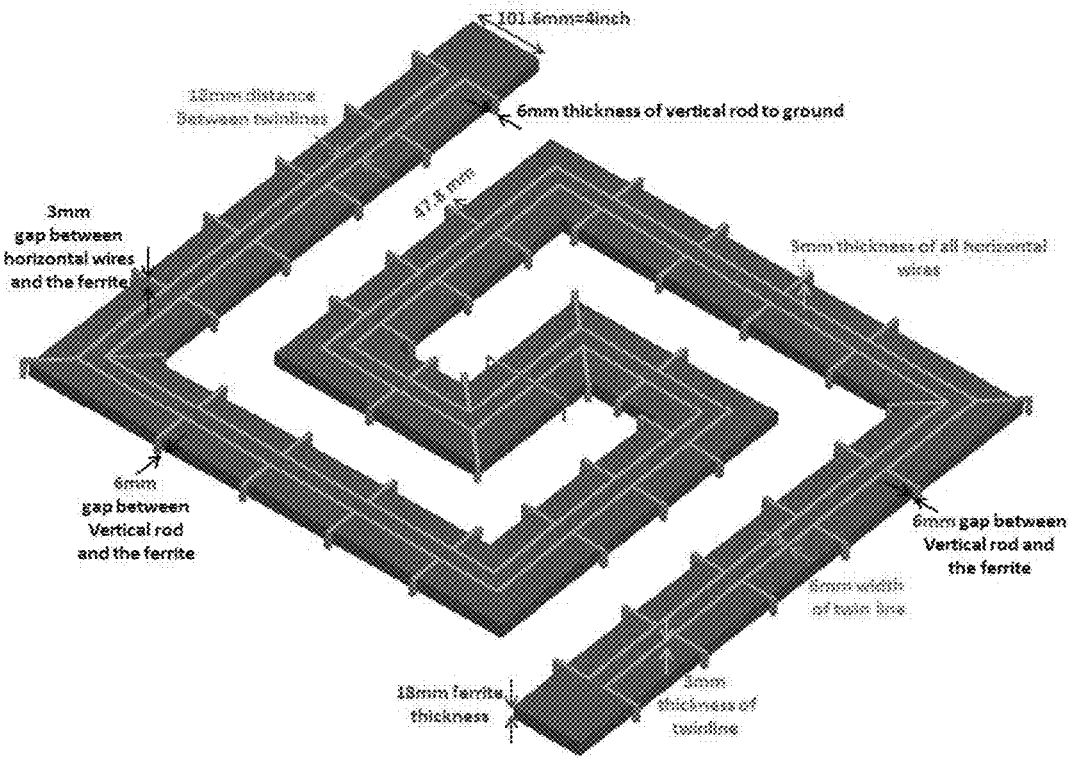
FIG. 46 shows a model and dimension of the final design of the magnetic spiral antenna.

FIG. 46 shows the final antenna geometry with the dimensions. The distance between the vertical rods and the ferrite is 6 mm. and the distance between the horizontal rods and the ferrite is 3 mm. The solenoid included of 30 loops to ground and there is no resistor termination needed.

Figure 47A:
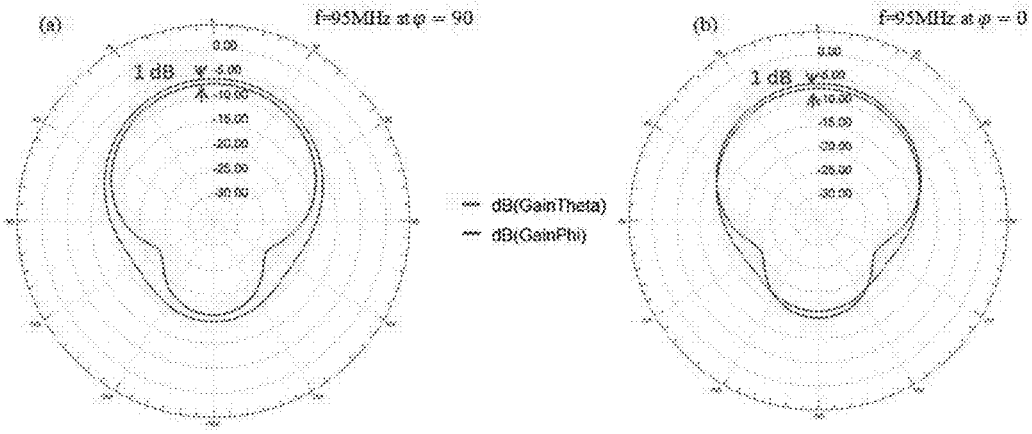
FIG. 47A shows the $Gain_\theta$ pattern at f=95 MHz at φ=0 and φ=90.
Figure 47B:
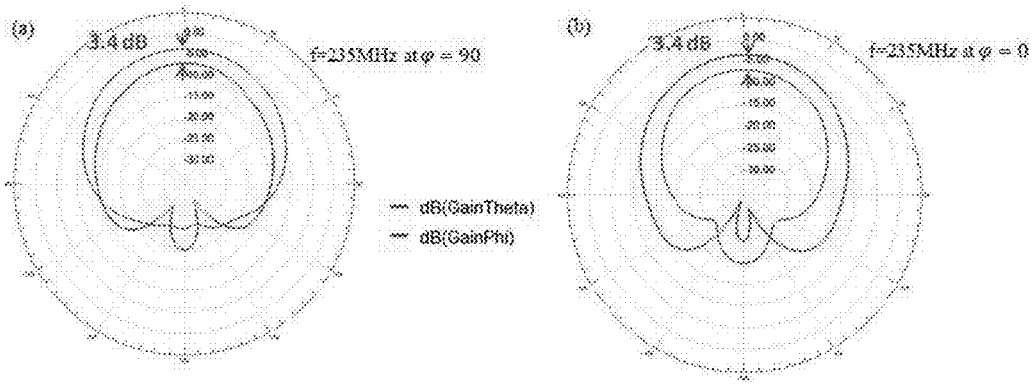
FIG. 47B shows the $Gain_\theta$ pattern at f=235 MHz at φ=0 and φ=90.

In order to see if the antenna has a circular polarization we will plot the antenna pattern in a lower and a higher frequency. We see that we have a very good circular polarization in lower frequencies and the axial ratio get worse as we go to higher frequency. FIG. 47 shows the $Gain_\theta$ pattern at f=95 MHz at φ=0 and φ=90 and FIG. 48 shows the $Gain_\theta$ pattern at f=235 MHz at φ=0 and φ=90.

Figure 48:
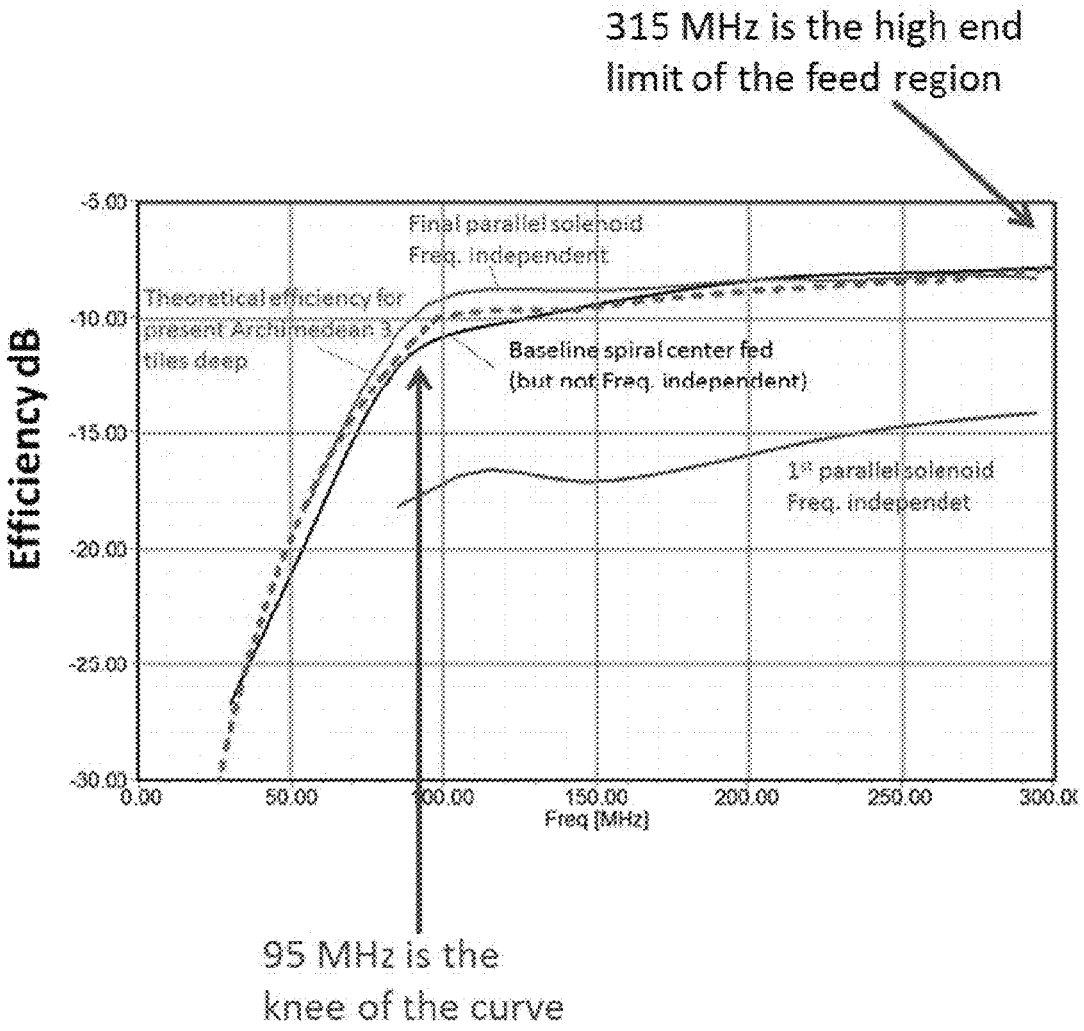
FIG. 48 shows a plot of the efficiency of the final parallel solenoid fed antenna, the theoretical efficiency of a Archimedean antenna with a height of 18 millimeters and the spiral fed with a single loop and the antenna when the solenoid is touching the surface.

FIG. 48 shows the efficiency of the final parallel solenoid fed antenna, the theoretical efficiency of an Archimedean antenna with a height of 18 mm. and the spiral fed with a single loop and the antenna when the solenoid is touching the surface of the ferrite. The center fed spiral has high efficiency but is not frequency independent and the case of the solenoid touching the ferrite has a frequency independent behavior but has low efficiency. It can be seen that the antenna design has both high gain and a frequency independent behavior.

Figure 49:
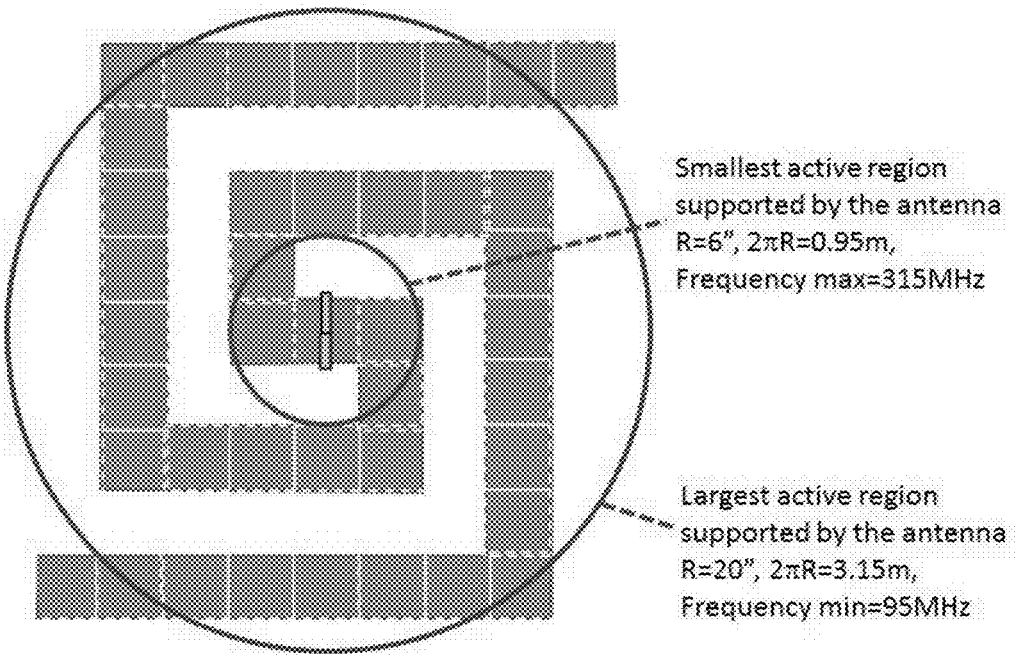
FIG. 49 shows a smallest and largest active region of the designed Archimedean spiral antenna using 123 ferrite tiles.

Also as mentioned above, and shown in FIG. 31, any spiral antenna has a high and low frequency limit. In the specific case of the antenna, as shown in FIG. 49, the largest active region which defines the low end is approximately when the outer perimeter is 1 lambda which in this case is at 95 MHz (larger circle). The high end has to start around the smaller circle since the central three tiles would be just a linear dipole. This is about 0.95 m in perimeter or 315 MHz. This behavior will show itself as a drop in efficiency and gain after 315 MHz.

V. Conclusion

In previous Examples, we had shown that using the new concept of parallel solenoid feed system for permeable antennas instead of the conventional feeds, is the solution to problems such as significant phase delays which will eventually cause destructive interference. We had also shown that in magnetic antennas such as toroidal magnetic antennas and rods, using the solenoid feed will enhance the performance of the antenna by maintaining the flux which results in higher peak gain and higher realized gain and it can be used as a tuning mechanism to achieve specific design goals.

In this Example, we have demonstrated the importance of using the parallel solenoid feed mechanism for a magnetic Archimedean spiral antenna. We have proved that by adding the parallel solenoid feed to the magnetic spiral antenna we could get high gain and efficiency, frequency independent behavior resulting in a very good VSWR, and a good axial ratio which shows the necessity of using the parallel solenoid feed for these types of antennas.

Thus, the present disclosure provides systems and methods for enhancing the performance of permeable antennas. Further, the parallel solenoid feed system disclosed herein may be used to reduce or eliminate significant phase delays in antennas, which may lead to destructive interference. Moreover, use of the parallel solenoid feed in an antenna eliminates the need for multiple feeds, complicated feed networks, and elaborate matching circuits. Using the parallel solenoid feed in circular magnetic antennas may enhance the performance of the antenna through maintaining the flux. Finally, many adjustable parameters for further tuning and/or optimizing the performance of particular antenna design have been identified herein, which may allow those skilled in the art to utilize known systems, such as full wave simulation software, to determine the desired final design for an antenna utilizing a parallel solenoid feed.

While there has been shown and described what are at present considered the preferred embodiments of the invention, it will be obvious to those skilled in the art that various changes and modifications can be made therein without departing from the scope of the invention defined by the appended claims.

What is claimed is:

1. A feed for a magnetic antenna with a ground plane, the magnetic antenna having a width, a height perpendicular to the ground plane, and a length longer than the width and the height, the feed comprising:

a first conductor and a second conductor bisecting the width of the magnetic antenna;

a first set of shorting pins electrically connecting the first conductor and the ground plane at generally regular intervals along the length of the antenna; and a second set of shorting pins electrically connecting the second conductor and the ground plane at generally regular intervals along the length of the antenna.

2. The feed of claim 1, wherein the first set of shorting pins and the second set of conductor pins are substantially parallel to the width of the magnetic antenna.

3. The feed of claim 1, wherein the first conductor is electrically connected to an inner conductor of a coaxial feed and the second conductor is electrically connected to an outer conductor of the coaxial feed.

4. The feed of claim 1, wherein:

the first and second conductors are substantially parallel to the length of the magnetic antenna; and the magnetic antenna is a dipole antenna and is excited by a substantially in-phase magnetic current induced by the first and second conductors.

5. The feed of claim 4, wherein a distance between the first and second sets of shorting pins is equal to:

$$2\sqrt{\frac{2hw}{\pi}} \pm 50\%$$

wherein h and w are the height and width of the magnetic antenna, respectively.

6. The feed of claim 1, wherein:

the magnetic antenna is a circular magnetic antenna;

the feed comprises a set of feed loops;

the first conductor comprises a set of first conductors, wherein each conductor in the set of first conductors is electrically connected to a feed loop in the set of feed loops; and the second conductor comprises a set of second conductors, wherein each conductor in the set of second conductors is electrically connected to a feed loop in the set of feed loops.

7. The feed of claim 6, wherein the first and second sets of shorting pins are substantially parallel to the width of the magnetic antenna.

8. The feed of claim 6, wherein the set of feed loops is substantially parallel to the width of the magnetic antenna at substantially regular intervals along the length of the magnetic antenna.

9. The feed of claim 6, wherein each feed loop in the set of feed loops is electrically connected to a coaxial feed loop, the coaxial feed loop having an inner conductor electrically connected to a conductor in the set of first conductors and an outer conductor electrically connected to a conductor in the set of second conductors.

10. The feed of claim 6, wherein:

the first and second sets of shorting pins are arranged in groups of shorting pins, wherein each group of shorting pins corresponds to a feed loop in the set of feed loops; and within each group of shorting pins, the first and second sets of shorting pins and the corresponding feed loops are arranged at substantially regular intervals along the length of the magnetic antenna.

11. The feed of claim 10, wherein, within each group of shorting pins, a distance between the first and second sets of shorting pins is equal to:

$$2\sqrt{\frac{2hw}{\pi}} \pm 50\%$$

wherein h and w are the height and width of the magnetic antenna, respectively.

12. The feed of claim 1, wherein the first conductor is separated from the magnetic antenna by a distance substantially equal to a largest cross section of the first conductor.

13. The feed of claim 1, wherein the second conductor is separated from the magnetic antenna by a distance substantially equal to a largest cross section of the second conductor.

14. The feed of claim 1, wherein the first set of shorting pins is separated from the magnetic antenna by a distance substantially equal to a largest cross section of the first set of shorting pins.

15. The feed of claim 1, wherein the second set of shorting pins is separated from the magnetic antenna by a distance substantially equal to a largest cross section of the second set of shorting pins.

16. The feed of claim 1, wherein the first set of shorting pins include a circuit element between the first conductor and the ground plane.

17. The feed of claim 16, wherein the circuit element is a resistor, an inductor, or a capacitor.

18. The feed of claim 1, wherein the second set of shorting pins include a circuit element between the second conductor and the ground plane.

19. The feed of claim 18, wherein the circuit element is a resistor, an inductor, or a capacitor.

20. The feed of claim 1, wherein the magnetic antenna comprises a magnetic material with a permeability and a permittivity, wherein the permeability is at least three times greater than the permittivity in magnitude.

21. The feed of claim 1, wherein:

the magnetic antenna is a spiral magnetic antenna.

* * * * *